US008185017B2

(12) United States Patent
Yamashita et al.

(10) Patent No.: US 8,185,017 B2
(45) Date of Patent: May 22, 2012

(54) IMAGE FORMING APPARATUS AND PROCESS CARTRIDGE

(75) Inventors: Masahide Yamashita, Tokyo (JP); Mie Yoshino, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 385 days.

(21) Appl. No.: 12/603,649

(22) Filed: Oct. 22, 2009

(65) Prior Publication Data

US 2010/0111564 A1 May 6, 2010

(30) Foreign Application Priority Data

Nov. 4, 2008 (JP) ..... 2008-283444

(51) Int. Cl.
*G03G 15/00* (2006.01)

(52) U.S. Cl. ..... 399/159; 399/116

(58) Field of Classification Search ..... 399/116, 399/159
See application file for complete search history.

(56) References Cited

U.S. PATENT DOCUMENTS 4,353,639 A * 10/1982 Moraw et al. ..... 399/249
7,218,879 B2 5/2007 Enoki et al.
7,315,711 B2 1/2008 Ariizumi et al.
2004/0109706 A1* 6/2004 Kosuge et al. ..... 399/168
2007/0224528 A1 9/2007 Yamashita et al.

FOREIGN PATENT DOCUMENTS

JP 9-211975 8/1997
JP 2000-194191 7/2000
JP 2006-98601 4/2006

* cited by examiner

*Primary Examiner* — Ryan Walsh
(74) *Attorney, Agent, or Firm* — Cooper & Dunham, LLP

(57) ABSTRACT

An electrophotographic image forming apparatus including an image bearing member which is a rotatable photoconductor containing an organic photoconductive layer on a conductive cylindrical support, a latent electrostatic image forming unit configured to charge the image bearing member to form a latent electrostatic image thereon, and a developing unit configured to develop the latent electrostatic image on the image bearing member with a developer to form a visible image, wherein the thickness of the organic photoconductive layer monotonically decreases or increases along the rotational axis from one end to the other end, wherein the developing unit includes a development sleeve for bearing and transferring the developer to a developing region, and wherein a development gap is formed between the image bearing member and the development sleeve, and becomes narrower from one end where the organic photoconductive layer is thicker to the other end where the organic photoconductive layer is thinner.

12 Claims, 5 Drawing Sheets

IMAGE FORMING APPARATUS AND PROCESS CARTRIDGE

BACKGROUND OF THE INVENTION

1. Field of the Invention

The present invention relates to an electrophotographic image forming apparatus including a latent electrostatic image forming unit, an image bearing member, and a developing unit; and to a process cartridge.

2. Description of the Related Art

Conventionally, electrophotographic image forming methods include forming a latent electrostatic image on an image bearing member which has a photoconductive layer containing, for example, a photoconductive material; and depositing charged toner particles on the latent electrostatic image to form a visible image. After transferred onto a recording medium such as paper, the visible image is fixed by, for example, heat, pressure and solvent gas, to thereby obtain an output image.

In terms of a method for charging a toner to be used for forming a visible image, such electrophotographic image forming methods are roughly classified into two-component developing methods in which a toner and a carrier are stirred/mixed to charge the toner with friction generated therebetween; and one-component developing methods in which a toner is charged with no use of a carrier. Further, based on whether or not a magnetic force is utilized for retaining a toner on a developing roller, the one-component developing methods are further classified into one-component magnetic developing methods and one-component non-magnetic developing methods.

Hitherto, in copiers, complex machines based upon the copiers, and the like for which high-speed processing capability and favorable image reproducibility are required, the two-component developing methods have been employed in many cases due to demands for stable chargeability of toner particles, stable charge rising properties of the toner particles, long-term stability of image quality, etc.; whereas in compact printers, facsimiles, etc. for which space saving, cost reduction and the like are required, the one-component developing methods have been employed in many cases.

Also, nowadays in particular, colorization of output images is progressing, and demands for increase in the quality of images and stabilization of image quality are increasing like never before. For higher image quality, toners have been made smaller in average particle diameter, and particles of the toners have been made rounder in shape with their angular parts removed.

Generally, in an image forming apparatus which operates in accordance with any such electrophotographic image forming method, regardless of which developing method is employed, a drum-shaped or belt-shaped image bearing member is uniformly charged while being rotated, a latent image pattern is formed on the image bearing member by laser light or the like, and the latent image pattern is visualized as a toner image by a developing device and transferred onto a recording medium. After the toner image has been transferred onto the recording medium, untransferred toner components remain on the image bearing member. If such residues are directly conveyed to a place for the charging step, it often hinders the image bearing member from being uniformly charged; accordingly, in general, the toner components, etc. remaining on the image bearing member are removed at a cleaning step subsequent to the transfer step, thereby bringing the surface of the image bearing member into a clean enough state, and then charging is carried out.

Hitherto, in order for the latent image on the image bearing member to be uniformly developed for forming a visible image, a toner or developer is supplied in a temporally and spatially uniform amount to a developing region which is a developing gap spaced as uniformly as possible (see, for example, Japanese Patent Application Laid-Open (JP-A) Nos. 09-211975 and 2000-194191).

Also, when an image bearing member before latent electrostatic image formation is ununiform in charged potential from place to place, the formed latent image formed thereon is adversely affected to be ununiform in potential, finally causing ununiformity of the formed visible image in some cases. Thus, when such an image forming method is employed, it is required that the image bearing member do not has charged potential ununiform from place to place.

Meanwhile, in general, a photoconductive layer used in the image bearing member is roughly classified into an inorganic photoconductive layer made, for example, of amorphous silicon and selenium; and an organic photoconductive layer made, for example, of polysilane and phthalopolymethine.

On the market, image forming apparatuses each having an image bearing member containing an organic photoconductive layer are often used in terms of safety of the material itself, allowing easy production, and cost.

The image bearing member containing an organic photoconductive layer is generally formed as follows. Specifically, a plurality of layers having different functions are sequentially formed on the surface of a base such as a conductive cylinder by repeating coating and drying at times required.

Thus, in order to uniform the charged potential, the photoconductive layer is required to have no thickness deviation. In particular, the thickness deviation of a charge transport layer having the dielectric function and contributing to maintenance of charges must be small sufficiently.

However, in an actual production of the image bearing member containing an organic photoconductive layer, much time and effort is required for forming a photoconductive layer having a uniform thickness, since the plurality of layers are formed on the surface of the base as described above. This causes elevation of the production cost for the image bearing member.

JP-A No. 09-211975 discloses a development sleeve having improved shape, in order to respond to a change in a developing gap which is caused when a developer enters the developing gap during use. But, such a development sleeve cannot compensate for the thickness deviation of the organic photoconductive layer to stabilize image quality. This proposal poses a problem in that it is difficult to provide a high-quality image at low cost.

JP-A No. 2000-194191 discloses a developing device having an inverted-crown-shaped developer bearing member. In this developing device, when the developer bearing member is pressed by a supply roller, a developing gap is constant between the developer bearing member and the image bearing member. But, such a developing device cannot compensate for the thickness deviation of the organic photoconductive layer to stabilize image quality. This proposal also poses a problem in that it is difficult to provide a high-quality image at low cost.

Further, JP-A No. 2006-98601 discloses a developing device in which a gap between a developer-controlling member and a developer bearing member can be controlled so that the amount of a developer supplied on the developer bearing member can be adjusted. This proposal can compensate for the difference in image density between the left-hand and right-hand sides. But, since the amount of a developer is made to be different between the left-hand and right-hand sides on the developer bearing member, unfavorable phenomena such as background smear tend to arise on the photoconductor. Also, this poses a problem in that extra efforts are required to adjust the amount of a developer supplied.

BRIEF SUMMARY OF THE INVENTION

The present invention solves the above existing problems and aims to achieve the following objects. Specifically, an object of the present invention is to provide an image forming apparatus which can provide a high-quality image at low cost and maintain high image quality for a long period of time.

Means for solving the above problems are as follows.

<1> An electrophotographic image forming apparatus including:

an image bearing member which is a rotatable photoconductor containing at least an organic photoconductive layer on a conductive cylindrical support, a latent electrostatic image forming unit configured to charge the image bearing member so as to form a latent electrostatic image thereon, and a developing unit configured to develop the latent electrostatic image on the image bearing member with a developer so as to form a visible image, wherein the thickness of the organic photoconductive layer monotonically decreases or increases in a direction along a rotational axis of the image bearing member from one end to the other end of the image bearing member, wherein the developing unit comprises a development sleeve for bearing and transferring the developer to a developing region, and wherein a development gap is formed between the image bearing member and the development sleeve, and becomes narrower from one end of the image bearing member where the organic photoconductive layer is thicker to the other end of the image bearing member where the organic photoconductive layer is thinner.

The image forming apparatus according to <1> above can form a high-quality image at low cost, leading to reduction of unnecessary cost.

<2> The electrophotographic image forming apparatus according to <1> above, wherein the developing gap satisfies the relations $5 \leqq D_{max}-D_{min} \leqq 20$ and $200 \leqq D_{max} \leqq 400$, where $D_{max}$ denotes a maximum value (μm) of the developing gap and $D_{min}$ denotes a minimum value (μm) of the developing gap.

<3> The electrophotographic image forming apparatus according to any one of <1> and <2> above, wherein the developing gap has a $D_r$ (%) of 2% to 7% which is defined by the following Equation 1:

$$D_r=(D_{max}-D_{min})/D_{max}\times 100(\%) \quad \text{Equation 1}$$

The image forming apparatuses according to <2> and <3> above can stably form a uniform visible image.

<4> The electrophotographic image forming apparatus according to any one of <1> to <3> above, wherein the thickness of the organic photoconductive layer satisfies the relations $0.3 \leqq T_{max}-T_{min} \leqq 1.5$ and $20 \leqq T_{max} \leqq 50$, where $T_{max}$ denotes a maximum thickness (μm) of the organic photoconductive layer and $T_{min}$ denotes a minimum thickness (μm) of the organic photoconductive layer.

The image forming apparatus according to <4> above can form a higher quality image without involving cost elevation, since the ununiformity of the developing gap for compensating for the ununiformity of the latent image is not too large.

<5> The electrophotographic image forming apparatus according to any one of <1> to <4> above, wherein the latent electrostatic image forming unit comprises a charging unit which is constant-current controlled.

<6> The electrophotographic image forming apparatus according to any one of <1> to <5> above, wherein the latent electrostatic image forming unit includes a charging roller which charges the image bearing member with being placed in contact with or close to the image bearing member.

<7> The electrophotographic image forming apparatus according to any one of <1> to <6> above, further including a cleaning unit configured to clean a surface of the image bearing member, wherein the cleaning unit comprises a cleaning blade.

<8> The electrophotographic image forming apparatus according to any one of <1> to <7> above, further including a protective agent-applying unit configured to apply a protective agent for protecting a surface of the image bearing member.

The image forming apparatuses according to <6> to <8> can form a high-quality image at low cost for a long period of time.

<9> The electrophotographic image forming apparatus according to any one of <1> to <8> above, wherein an uppermost surface layer is laid over the organic photoconductive layer.

<10> The electrophotographic image forming apparatus according to <9> above, wherein the uppermost surface layer has a thickness of 0.1 μm to 12 μm.

<11> The electrophotographic image forming apparatus according to any one of <1> to <10> above, wherein the development sleeve comprises two developing gap-adjusting rollers one of which has a larger diameter than the diameter of the other, and the developing gap-adjusting roller having the larger diameter is disposed at one end of the development sleeve at which the developing gap is larger than that of the other end of the development sleeve, and the developing gap-adjusting roller having the smaller diameter is disposed at the other end of the development sleeve at which the developing gap is smaller.

<12> A process cartridge used in an electrophotographic image forming apparatus, the process cartridge including:

an image bearing member which is a rotatable photoconductor containing at least an organic photoconductive layer on a conductive cylindrical support, a latent electrostatic image forming unit configured to charge the image bearing member so as to form a latent electrostatic image thereon, and a developing unit configured to develop the latent electrostatic image on the image bearing member with a developer so as to form a visible image, wherein the thickness of the organic photoconductive layer monotonically decreases or increases in a direction along a rotational axis of the image bearing member from one end to the other end of the image bearing member, wherein the developing unit comprises a development sleeve for bearing and transferring the developer to a developing region, and wherein a development gap is formed between the image bearing member and the development sleeve, and becomes narrower from one end of the image bearing member where the organic photoconductive layer is thicker to the other end of the image bearing member where the organic photoconductive layer is thinner.

Next will be described in more detail the reasons why the above means solve the above problems.

As described above in relation to the problems the prior art has, it is important for image forming apparatuses to constantly form a high-quality image. Formation of an image having more uniform image quality in an axial direction tends to involve cost elevation.

The present inventors conducted studies for solving the above problems pertinent in the art, and have found that, in order to stably continuously provide high image quality, it is important to form a developing gap in consideration of the thickness of the organic photoconductive layer of the image bearing member, rather than making small the deviation of the developing gap in the developing region. The present invention has been accomplished on the basis of this finding. Also, the production cost for the image bearing member can be reduced and thus, a high-quality image can be formed at low cost.

The image bearing member having a photoconductive layer with a uniform thickness along the rotational axis direction involves no difference in dielectric constant from place to place and thus, the electrostatic capacitance per unit area is constant. When this image bearing member is charged with, for example, a corotron or scorotron, the amount of charges supplied is constant at any places and thus, the charged potential is constant in the rotational axis direction.

In contrast, in the image bearing member having an organic photoconductive layer monotonously decreasing or increasing in thickness along the rotational axis direction from one end to the other end, a portion of the organic photoconductive layer which has a smaller thickness has a greater electrostatic capacitance. Thus, even when charges are constantly supplied to the organic photoconductive layer, the portion of the organic photoconductive layer which has a smaller thickness has a smaller charged potential.

In the case where the image bearing member has different charged potentials along the rotational axis direction, non-image portions after latent electrostatic image formation by exposure still have different charged potentials along the rotational axis direction.

When a developing unit having a uniform developing gap is used to visualize such a latent electrostatic image, a bias potential which is applied to a development sleeve and is set to a value between the potential of image portions and that of non-image portions may not have a sufficient potential difference. As a result, unfavorable phenomena occur in the formed image, such as insufficient image density, insufficient density gradation and background smear, making it difficult to ensure sufficient image quality. That is why difficulty is encountered in using an image bearing member which has an organic photoconductive layer monotonically decreases or increases in thickness in a direction along its rotational axis from one end and the other end.

In contrast, in the image forming apparatus of the present invention, as described above, a developing gap becomes narrower on the side where the thickness of the organic photoconductive layer is thinner; i.e., the electric capacity is larger (in other words, on the side where the charged potential of the image bearing member is lower). Thus, when a uniform bias potential is applied on the development sleeve, the electric intensity in the developing region on the side where the charged potential is lower becomes larger than that on the other side where the thickness of the organic photoconductive layer is thicker; i.e., the electric capacity is smaller (in other words, on the side where the charged potential of the image bearing member is higher).

In the present invention, by making ununiform a developing gap between a developing sleeve and an image bearing member, thereby compensating for ununiformity in surface potential due to the difference in electric capacity of the image bearing member from place to place, a latent image can uniformly be visualized. That is, for forming a uniform visible image, a developing gap in a developing region in portions having lower charged potential becomes narrower to increase electric intensity, thereby increasing electrostatic force applied from an effective electric fields to toner particles; and a developing gap in a developing region in portions having higher charged potential becomes wider to decrease electric intensity, thereby decreasing electrostatic force applied from an effective electric fields to toner particles.

As a result, the coating speed can be increased in the production process of an image bearing member having an organic photoconductive layer, leading to reduction of the production cost per image bearing member and hence to cost reduction of an image forming apparatus.

The present invention can solve the above existing problems and aim to achieve the above objects. Specifically, the present invention provides an image forming apparatus which can provide a high-quality image at low cost and maintain high image quality for a long period of time.

DETAILED DESCRIPTION OF THE INVENTION

Image Forming Apparatus

Figure 1:
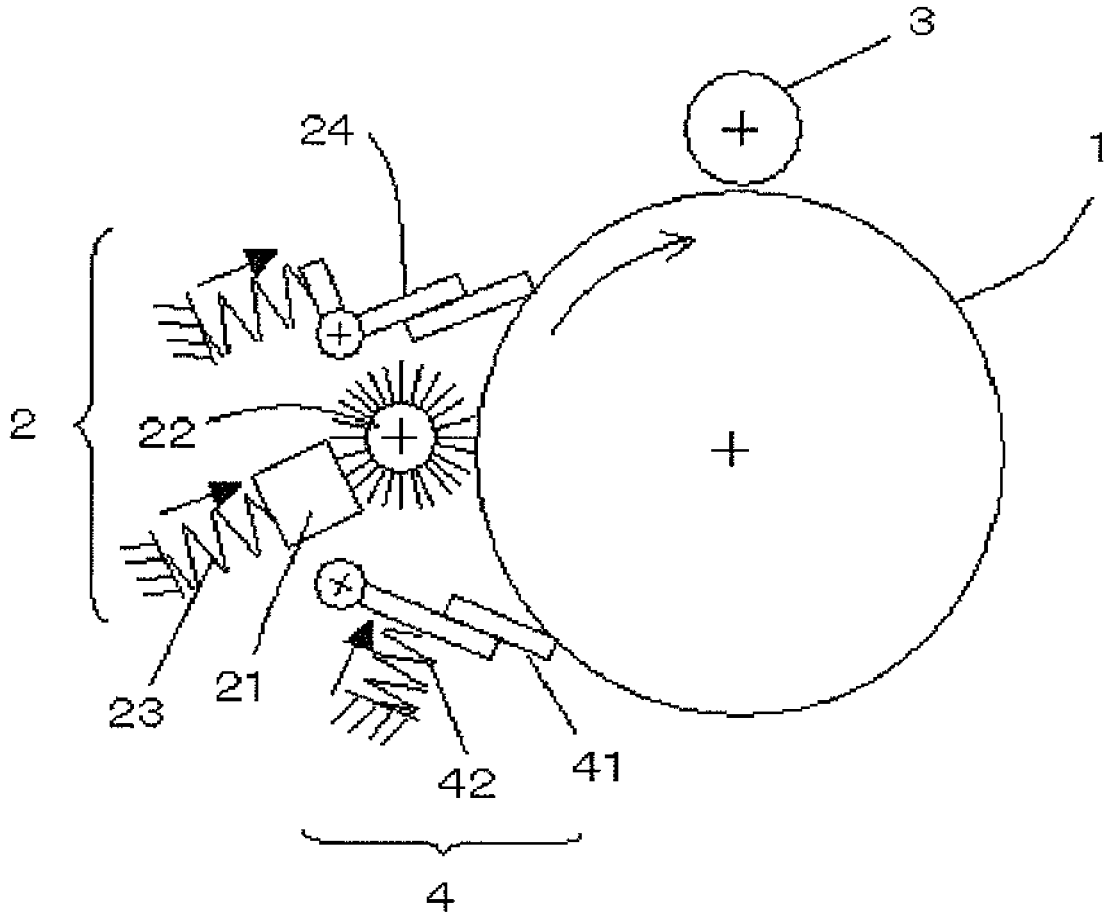
FIG. 1 is a schematic view of an exemplary cleaning device.

An image forming apparatus of the present invention includes an image bearing member, a charging unit and a developing unit; and, if necessary, includes other units.

—Image Bearing Member—

The image bearing member is not particularly limited, so long as it is a rotatable photoconductor including a conductive cylindrical support and at least an organic photoconductive layer on the support, and may be appropriately selected depending on the purpose.

—Conductive Cylindrical Support—

The conductive cylindrical support is not particularly limited, so long as it has a conductivity of $1.0\times10^{10}$ Ω·cm or less in volume resistance, and may be appropriately selected depending on the purpose. Examples thereof include a construction formed by coating a cylindrical plastic, a reinforced glass, etc. with a metal such as aluminum, nickel, chrome, Nichrome, copper, gold, silver or platinum or with a metal oxide such as tin oxide or indium oxide by means of vapor deposition or sputtering; and a tube produced by forming aluminum, aluminum alloy, nickel, stainless, etc. into a drum-shaped mother tube by means of drawing, extrusion, etc. and then surface-treating the mother tube by means of cutting, superfinishing, polishing, etc. These have a drum shape (cylindrical shape).

The diameter of the conductive cylindrical support is not particularly limited and may be appropriately determined depending on the purpose. It is preferably 20 mm to 150 mm, more preferably 24 mm to 100 mm, particularly preferably 28 mm to 70 mm. If the conductive cylindrical support has a diameter less than 20 mm, it is physically difficult to place therearound members for the steps of charging, exposing, developing, transferring and cleaning. If the conductive cylindrical support has a diameter greater than 150 mm, it is undesirable because the image forming apparatus is enlarged. Particularly in the case where the image forming apparatus is of tandem type, it is necessary to install a plurality of photoconductors therein, so that the diameter of the support of each photoconductor is preferably 70 mm or less, more preferably 60 mm or less.

—Organic Photoconductive Layer—

The organic photoconductive layer is not particularly limited, so long as it monotonically decreases or increases in thickness from one end to the other end of the image bearing member along the rotational axis of the image bearing member, and may be appropriately selected depending on the purpose.

As used herein, the expression "organic photoconductive layer monotonically decreases or increases in thickness from one end to the other end of the image bearing member along the rotational axis of the image bearing member" means that when the thicknesses of the organic photoconductive layer measured at equally-spaced 10 points or more along the rotational axis are approximated by the least-squares method to a quadratic function in which the explanatory variable is a positional datum and the response variable is a thickness of the organic photoconductive layer, the obtained quadratic function does not have a maximal value or a minimal value at positional data in a range where the organic photoconductive layer is present.

The thicknesses of the organic photoconductive layer can be measured using, for example, an eddy current thickness meter (versatile thickness meter LZ-200, product of Kett Electric Laboratory, LHP-20 (NFe)-type probe).

When the thickness of the organic photoconductive layer has a maximal or minimal value at positional data in a range where the organic photoconductive layer is present, the charged potential also has a maximal or minimal value. Thus, even when the below-described developing gap is adjusted such that the electric intensity for development monotonically changes in a direction along the rotational axis of the image bearing member, it is difficult to uniformly visualize a latent electrostatic image.

The organic photoconductive layer is, for example, a single layer containing a charge generation material and a charge transport material, a normal-type layer containing a charge transport layer over a charge generation layer, or an inverted layer containing a charge generation layer over a charge transport layer.

Further, an uppermost surface layer may be provided on the organic photoconductive layer, in order to improve the mechanical strength, abrasion resistance, gas resistance, cleanability, etc. of the photoconductor. Also, an underlying layer may be provided between the organic photoconductive layer and the conductive support. Further, a blocking layer may be provided for ensuring that the underlying layer exhibits the function of preventing change injection.

If necessary, a plasticizer, an antioxidant, a leveling agent, etc. may be added in an appropriate amount to each of the layers.

As used herein, the "thickness of the organic photoconductive layer" refers to a total thickness of the layers formed on the conductive support, including the underlying layer, the blocking layer, and the uppermost layer which are formed on the conductive support as desired.

The thickness of the organic photoconductive layer preferably satisfies the relations $0.3 \leqq T_{max}-T_{min} \leqq 1.5$ and $20 \leqq T_{max} \leqq 50$, where $T_{max}$ denotes the maximum thickness (μm) of the organic photoconductive layer and $T_{min}$ denotes the minimum thickness (μm) of the organic photoconductive layer.

When the thickness satisfies these relations, uniform visible images can be formed for a long period of time and thus, an image forming apparatus which involves small variation over time can be provided.

When the difference $T_{max}-T_{min}$ is less than 0.3 μm, the cost for formation of the photoconductive layer is too elevated, which is not preferred for practical use. Whereas when the difference $T_{max}-T_{min}$ is greater than 1.5 μm, the ununiformity of the developing gap is required to be larger for compensating for the ununiformity of the latent image and thus, the electric field is widened to potentially decrease resolution of the formed image, which is not preferred. Also, when $T_{max}$ is less than 20 μm or greater than 50 μm, there is intricate in many cases a process of producing an organic photoconductive layer which monotonically decreases or increases in thickness from one end to the other end of the image bearing member along the rotational axis of the image bearing member. Thus, the image bearing member cannot be necessarily obtained at low cost.

Examples of a charge generation material used in the organic photoconductor include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used individually or in combination.

Examples of a charge transport material used in the organic photoconductor include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used individually or in combination.

Binder resin(s) used in forming the organic photosensitive layer is/are electrically insulative and may be selected from known thermoplastic resins, thermosetting resins, photocurable resins and photoconductive resins.

Suitable examples thereof include thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; polyvinylcarbazole, polyvinylanthracene and polyvinylpyrene. These may be used individually or in combination.

Examples of the antioxidant used in the organic to photoconductive layer include phenolic compounds, p-phenylenediamines, hydroquinones, sulfur-containing organic compounds and phosphorus-containing organic compounds.

Examples of the phenolic compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]m ethane, bis[3,3'-bis(4'-hydroxy-3'-t-butylphenyl)butylic acid]glycol ester and tocopherols.

Examples of the p-phenylenediamines include N-phenyl-N'-isopropyl-p-phenylenediamine, N,N'-di-sec-butyl-p-phenylene diamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur-containing compounds include dilauryl-3,3'-thiodipropionate, distearyl-3,3'-thiodipropionate and ditetradecyl-3,3'-thiodipropionate.

Examples of the organic phosphorus-containing compounds include triphenylphosphine, tri(nonylphenyl)phosphine, tri(dinonylphenyl)phosphine, tricresylphosphine and tri(2,4-dibutylphenoxy)phosphine.

These compounds are known as an antioxidant for rubbers, plastics, and oils and fats and commercially available.

The amount of the antioxidant added is preferably 0.01% by mass to 10% by mass with respect to the total mass of the layer to which the antioxidant is to be added.

For the plasticizer used in the organic photosensitive layer, a resin such as dibutyl phthalate or dioctyl phthalate commonly used as a plasticizer can be used without the need to change it in any way. It is appropriate that the amount of the plasticizer used be 0 parts by mass to 30 parts by mass per 100 parts by mass of the binder resin.

Additionally, a leveling agent may be incorporated into the organic photosensitive layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass per 100 parts by mass of the binder resin.

—Underlying Layer—

The underlying layer is not particularly limited and may have a single-layer or multi-layer structure. Examples thereof include (1) layers made mainly of resin, (2) layers made mainly of a white pigment and resin, and (3) metal oxide films produced by chemically or electrochemically oxidizing the conductive base surface. Among them, preferred are layers made mainly of a white pigment and resin.

The white pigment is not particularly limited, and examples thereof include metal oxides such as titanium oxide, aluminum oxide, zirconium oxide and zinc oxide. Among them, titanium oxide is particularly preferred since it can effectively prevent injection of charges derived from a conductive support.

The resin is not particularly limited, and examples thereof include thermoplastic resins such as polyamides, polyvinyl alcohol, casein and methyl cellulose; and thermosetting resins such as acrylic resins, phenol resins, melamine resins, alkyd resins, unsaturated polyester resins and epoxy resins. These may be used individually or in combination.

The thickness of the underlying layer is not particularly limited and may be appropriately determined depending on the purpose. It is preferably 0.1 μm to 10 μm, more preferably 1 μm to 5 μm.

As described above, the uppermost surface layer is provided in order to improve the mechanical strength, abrasion resistance, gas resistance, cleanability, etc. of the photoconductor.

The material for the uppermost surface layer is not particularly limited. For example, preferred are a polymer having a greater mechanical strength than the photosensitive layer and a polymer containing an inorganic filler dispersed therein.

The polymer used for the uppermost surface layer is not particularly limited and may be a thermoplastic polymer or a thermosetting polymer. Preferred are thermosetting polymers having a high mechanical strength and highly capable of reducing abrasion caused by friction with a cleaning blade.

As long as the surface layer is thin, there may be no problem if it does not have charge transporting capability; however, when a thick surface layer not having charge transporting capability is formed as the uppermost surface layer, the photoconductor is easily caused to decrease in sensitivity, increase in electric potential after exposure, and increase in residual potential, so that it is desirable to mix the above-mentioned charge transporting material into the uppermost surface layer or use a polymer with charge transporting capability for forming the uppermost surface layer.

Generally, the organic photosensitive layer and the uppermost surface layer greatly differ from each other in mechanical strength, so that once the uppermost surface layer is abraded due to friction with the cleaning blade and thus disappears, the photosensitive layer is also abraded; therefore, when the uppermost surface layer is provided, it is important to make it have a sufficient thickness.

In view of this, the thickness of the uppermost surface layer is preferably 0.1 μm to 12 μm, more preferably 1 μm to 10 μm, particularly preferably 2 μm to 8 μm.

If the thickness is less than 0.1 μm, it is not desirable because the uppermost surface layer is so thin that parts of the uppermost surface layer easily disappear owing to friction with the cleaning blade, and abrasion of the photosensitive layer progresses through the missing parts. If the thickness is greater than 12 μm, it is not desirable because the photoconductor is easily caused to decrease in sensitivity, increase in electric potential after exposure, and increase in residual potential. Particularly when a polymer with charge transporting capability is used, the cost of the polymer increases.

As the polymer used for the uppermost surface layer, a polymer which is transparent to writing light at the time of image formation and superior in insulation, mechanical strength and adhesiveness is desirable. Non-limiting examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylenes, polybutylene terephthalates, polycarbonates, polyethersulfones, polyethylenes, polyethylene terephthalate, polyimides, acrylic resins, polymethylpentene, polypropylene, polyphenylene oxide, polysulfones, polystyrene, AS resins, butadiene-styrene copolymers, polyurethanes, polyvinyl chloride, polyvinylidene chloride and epoxy resins.

The polymer exemplified by these may be a thermoplastic polymer. When a thermosetting polymer produced by cross-linkage with a polyfunctional cross-linking agent having an acryloyl group, carboxyl group, hydroxyl group, amino group, etc. is used as the polymer to enhance its mechanical strength, the uppermost surface layer increases in mechanical strength and it becomes possible to greatly reduce abrasion of the uppermost surface layer caused by friction with the cleaning blade.

The above uppermost surface layer preferably has charge transporting capability.

The method for imparting charge transporting capability to the uppermost surface layer is not particularly limited. For example, it is possible to employ a method in which a polymer used for the uppermost surface layer and the above-mentioned charge transporting material are mixed together, or a method in which a polymer having charge transporting capability is used as the surface layer, with the latter method being preferable because a photoconductor which is highly sensitive and does not increase much in electric potential after exposure or in residual potential can be obtained.

The polymer having charge transporting capability is not particularly limited and may be appropriately selected depending on the purpose. For example, preferred are polymers containing a group represented by the following structural formula (i) as a group having charge transporting capability.

Structural Formula (i)

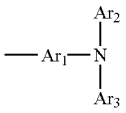

In Structural Formula (i), $Ar_1$ represents an arylene group which may have a substituent; and $Ar_2$ and $Ar_3$, which may be identical or different, each represent an aryl group which may have a substituent.

Such a group that has charge transporting capability is preferably added to the side chain(s) of a polymer having high mechanical strength, such as polycarbonate resins and acrylic resins. Of these, acrylic resins are preferably used, since they are excellent in coatability and curability, and their monomers can be readily produced.

By using such acrylic resins having charge transporting capability that are produced thorough polymerization of unsaturated carboxylic acid having the group represented by Structural Formula (i), a surface layer can be formed which has high mechanical strength, excellent transparency, and high charge transporting capability.

Also, when monofunctional unsaturated carboxylic acid having the group represented by Structural Formula (i) is mixed with polyfunctional (preferably, tri or more functional) unsaturated carboxylic acid, the formed acrylic resin has a crosslinked structure and is thermosetting polymer. Use of such an acrylic resin allows a surface layer to be increased in mechanical strength.

The group represented by Structural Formula (i) may be added to the polyfunctional unsaturated carboxylic acid. In this case, the production cost of monomers disadvantageously increases. Thus, the polyfunctional unsaturated carboxylic acid used is preferably a photocurable polyfunctional monomer, rather than the polyfunctional unsaturated carboxylic acid to which the group represented by Structural Formula (i) has been added.

Examples of the monofunctional unsaturated carboxylic acid having the group represented by Structural Formula (i) include those represented by the following Structural Formula (ii) or (iii).

Structural Formula (ii)

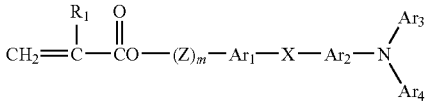

Structural Formula (iii)

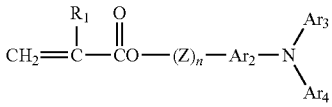

In Structural Formula (ii) or $R_1$ represents a hydrogen atom, a halogen atom, an alkyl group which may have a substituent, an aralkyl group which may have a substituent, an aryl group which may have a substituent, a cyano group, a nitro group, an alkoxy group which may have a substituent, —$COOR_7$ (where $R_7$ represents a hydrogen atom, an alkyl group which may have a substituent, an aralkyl group which may have a substituent, or an aryl group which may have a substituent), a halogenated carbonyl group, or $CONR_8R_9$ (where $R_8$ and $R_9$, which may be identical or different, each represent a hydrogen atom, a halogen atom, an alkyl group which may have a substituent, an aralkyl group which may have a substituent, or an aryl group which may have a substituent).

In Structural Formula (ii) or (iii), $Ar_1$ and $Ar_2$, which may be identical or different, each represent an arylene group which may have a substituent.

In Structural Formula (ii) or (iii), $Ar_3$ and $Ar_4$, which may be identical or different, each represent an aryl group which may have a substituent.

In Structural Formula (ii), X represents a single bond, an alkylene group which may have a substituent, a cycloalkylene group which may have a substituent, an alkylene ether group which may have a substituent, an oxygen atom, a sulfur atom or a vinylene group.

In Structural Formula (ii) or (iii), Z represents an alkylene group which may have a substituent, a divalent alkylene ether group which may have a substituent, or a divalent alkylene oxycarbonyl group.

In Structural Formula (ii) or (iii), each of m and n is an integer 0 to 3.

In Structural Formula (ii) or (iii), the alkyl group represented by $R_1$ is, for example, methyl, ethyl, propyl or butyl.

In Structural Formula (ii) or (iii), the aryl group represented by $R_1$ is, for example, phenyl or naphthyl; and the aralkyl group represented by $R_1$ is, for example, benzyl, phenethyl or naphthylmethyl.

In Structural Formula (ii) or (iii), the alkoxy group represented by $R_1$ is, for example, methoxy, ethoxy or propoxy.

The above-exemplified groups may have as a substituent a halogen atom, a nitro group, a cyano group; an alkyl group (e.g., a methyl group and an ethyl group); an alkoxy group (e.g., a methoxy group and an ethoxy group); an aryloxy group (e.g., a phenoxy group); an aryl group (e.g., a phenyl group and a naphthyl group); an aralkyl group (e.g., a benzyl group and a phenethyl group); other groups.

Among these substituents represented by $R_1$, particularly preferred are a hydrogen atom and a methyl group.

Examples of the aryl group represented by $Ar_3$ or $Ar_4$ include condensed polycyclic hydrocarbon groups, non-condensed cyclic hydrocarbon groups, and heterocyclic groups.

The condensed polycyclic hydrocarbon groups are preferably those whose ring-forming carbon atoms are 18 or less. Examples thereof include a pentanyl group, an indenyl group, a naphthyl group, an azulenyl group, a heptalenyl group, a biphenylenyl group, an as-indacenyl group, a s-indacenyl group, a fluorenyl group, an acenaphthylenyl group, a pleiadenyl group, an acenaphthenyl group, a phenalenyl group, a phenanthryl group, an anthryl group, a fluoranthenyl group, an acetophenanthrylenyl group, an acetoantrylenyl group, a triphenylenyl group, a pyrrenyl group, a chrysenyl group and a naphthacenyl group.

Examples of the non-condenced cyclic hydrocarbon groups include a monovalent group of a monocyclic hydrocarbon compound, such as benzene, diphenyl ether, polyethylene dipheny ether, diphenylthio ether and diphenyl sulfon; a monovalent group of a non-condensed multicyclic hydrocarbon compound, such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene; and a monovalent group of a collected-cyclic hydrocarbon compound, such as 9,9-diphenylfluorane.

Examples of the heterocyclic group include a monovalent group of a compound, such as carbazol, dibenzofuran, dibenzothiophene, oxadiazole and thiadiazole.

The amount of the polyfunctional unsaturated carboxylic acid is preferably 5% by mass to 75% by mass, more preferably 10% by mass to 70% by mass, particularly preferably 20% by mass to 60% by mass, based on the total amount of the uppermost surface layer. When the amount is less than 5% by mass, the formed uppermost surface layer has insufficient mechanical strength. Whereas when the amount is more than 75% by mass, the formed uppermost surface layer tends to decrease in sensitivity, since it involves crack formation on receiving a strong force.

When the uppermost surface layer is made of acrylic resin, it may be formed as follows. Specifically, a photoconductor is coated with the unsaturated carboxylic acid. Then, the photoconductor is irradiated with active light beams (e.g., electron beams and UV rays) to initiate radical polymerization, whereby a surface layer can be formed. When radical polymerization is initiated with active light beams, there is used a solution of a photopolymerization initiator in an unsaturated carboxylic acid. In general, the photopolymerization initiator used may be those for use in photocurable coating materials.

Preferably, the uppermost surface layer contains, for example, metal fine particles, metal oxide fine particles or other particles, in order to improve the mechanical strength thereof.

Examples of the metal oxides include titanium oxide, tin oxide, potassium titanate, TiO, TiN, zinc oxide, indium oxide and antimony oxide. Examples of the other fine particles include fluorine resins (e.g., polytetrafluoroethylene), silicone resins, and mixtures prepared by dispersing inorganic materials in these resins for improving their abrasion resistance.

The thickness of the photoconductive layer of the image bearing member which is produced using the above compositions may be measured with an electromagnetic or eddy current thickness meter depending on the material of the conductive support.

—Latent Electrostatic Image Forming Unit—

The latent electrostatic image forming unit is not particularly limited, so long as it can form a latent electrostatic image on the image bearing member by charging it, and may be appropriately selected depending on the purpose. Examples thereof include charging devices which can form a latent electrostatic image on the image bearing member by charging it.

The latent electrostatic image forming unit is configured to uniformly charge the surface of an image bearing member and imagewise expose the charged surface to light. It is not particularly limited, and includes, for example, a charging unit configured to uniformly charge the surface of an image bearing member and an exposing unit configured to imagewise expose the surface of the image bearing member to light.

The charging unit is not particularly limited and may be appropriately selected depending on the purpose. It preferably has a constant-current controlled charging unit. When the charging unit has such a constant-current controlled charging unit, the charged potential of the image bearing member depends on the thickness of the photoconductive layer, surely making it possible the mechanism by which a visible image can be uniformly formed in the present invention.

Further, the charging unit preferably contains a charging roller which charges an image bearing member with being placed in contact with or close to the image bearing member. When the charging unit contains such a charging roller, the charged potential, depending on the voltage applied to a charging roller and on the thickness of the photoconductive layer, can be ensured at lower application voltages, leading to reduction of power consumption.

Charging can be performed by applying a voltage to the surface of the image bearing member using, for example, the following charging devices.

The charging device is not particularly limited and may be appropriately selected depending on the purpose. Examples of the charging device include known contact type charging devices having a conductive or semiconductive roller, brush, film or rubber blade; and non-contact type charging devices employing corona discharge (e.g., a corotron and a scorotron). Among them, for the above reasons, preferred are charging devices containing a charging roller, in which a conductive or semiconductive roller charges the image bearing member with being place in contact with or close to the image bearing member.

Further, the charging device preferably contains a voltage applying unit configured to apply a voltage having AC components.

Exposing can be performed by imagewise exposing the surface of the image bearing member to light using, for example, an exposing device.

The exposing device is not particularly limited, so long as it attains desired imagewise exposure on the surface of the image bearing member which has been charged with a charging device, and can be appropriately selected depending on the purpose. Examples of the exposing device include various exposing devices such as copy optical exposing devices, rod lens array exposing devices, laser optical exposing devices, liquid crystal shutter exposing devices and LED optical devices.

In the present invention, light may be imagewise applied from the side facing the photoconductor support.

—Developing Unit—

The developing unit is a unit configured to form a visible image by developing the electrostatic latent image on the image bearing member with a developer. The developing unit has a development sleeve for bearing/transferring the developer to a developing region.

Also, the developing gap is defined by the image bearing member and the sleeve.

The developing unit is not particularly limited, so long as it contains the above components, and may be appropriately selected from those known in the art depending on the purpose. For example, preferred are those containing a developer and having at least a developing device which can apply the developer to the electrostatic latent image in a contact or non-contact manner.

—Developing Gap—

The developing gap is formed so that it becomes narrower from an end of the image bearing member where the organic photoconductive layer is thicker to the other end of the image bearing member where the organic photoconductive layer is thinner.

The developing gap preferably satisfies the relations $5 \leqq D_{max}-D_{min} \leqq 20$ and $200 \leqq D_{max} \leqq 400$, where $D_{max}$ denotes the maximum value (μm) of the developing gap and $D_{min}$ denotes the minimum value (μm) of the developing gap.

When the developing gap satisfies these relations, developer' magnetic brushes formed on the development sleeve can be disposed proximately to or brought into slight contact with a latent image on the image bearing member in the developing region. As a result, the dielectric distance is shortened to easily ensure sufficient ununiformity in the intensity of an electric field. Thus, a uniform visible image can be surely formed by the mechanism of the present invention, making it possible to stably form high-quality images.

Also, the developing gap preferably has a $D_r$ (%) of 2% to 7% which is defined by the following Equation 1.

$$D_r=(D_{max}-D_{min})/D_{max}\times 100(\%) \quad \text{Equation 1}$$

When $D_r$ (%) is 2% to 7%, the intensity of an electric field can be made ununiform depending on the gap of the developing gap, making it possible to stably form high-quality images.

When $D_r$ is smaller than 2%, a thicker portion of the organic photoconductive layer of the image bearing member tends to be excessively developed. Whereas when $D_r$ is greater than 7%, a thinner portion of the image bearing member of the organic photoconductive layer tends to be excessively developed. In both cases, it may be difficult to sufficiently compensate for the ununiformity in thickness of the organic photoconductive layer, resulting in that an ununiform visible image may be often formed.

The maximum value ($D_{max}$) and the minimum value ($D_{min}$) of the developing gap are measured as follows. Specifically, an image bearing member is appropriately disposed so as to face the developing device having a development sleeve from which a developer has been removed. In this state, the developing gaps are measured at equally-spaced 10 points or more along the rotational axis of the image bearing member from one end to the other end of thereof by known methods. Specifically, they may be appropriately measured by a mechanical method using a clearance gauge, or by a known non-contact optical method using, for example, a laser-displacement sensor, a sizer, or a long-range CCD camera.

—Development Sleeve—

Figure 3:
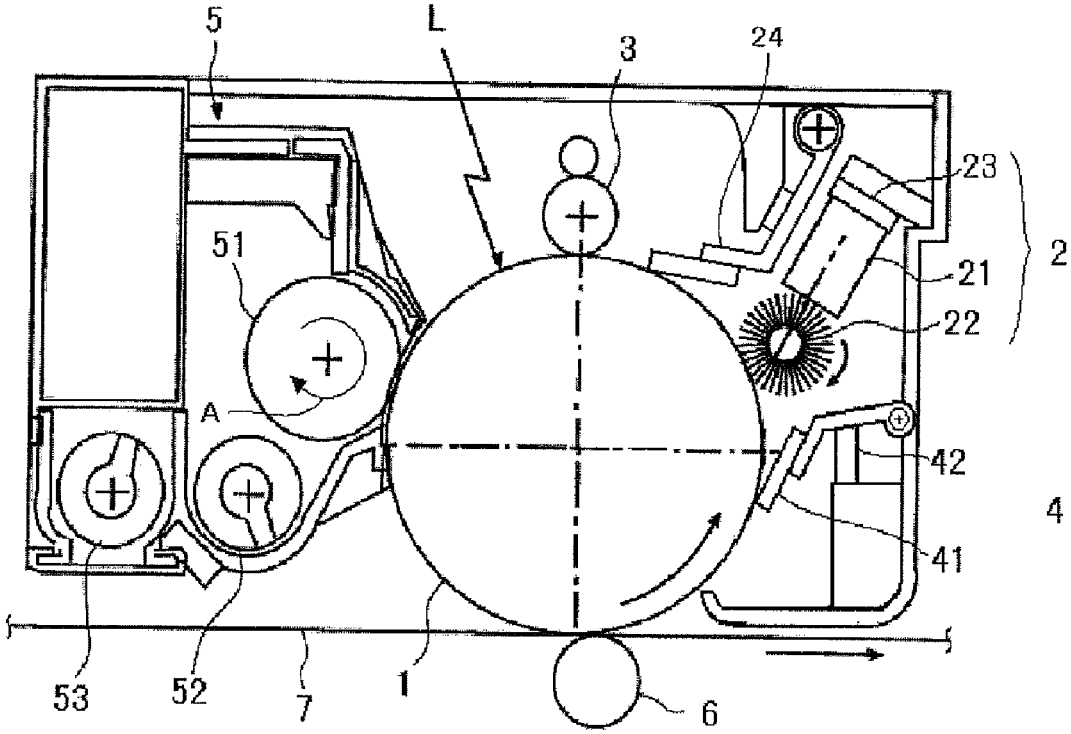
FIG. 3 is a schematic view of an exemplary process cartridge.

As shown in FIG. 3, a development sleeve (51), which is rotated clockwise (in a direction indicated by arrow A in FIG. 3) by a drive unit (not shown), has a magnet (not illustrated) as a magnetic field-generating unit for forming magnetic brushes by carrier particles. Here, the magnet is disposed in the development sleeve so that the distance between the magnet and a developing device (5) is constant.

A developer is supplied to the surface of the development sleeve when the development sleeve (51) and a developer-supplying screw (52) are rotated. The developer supplied is retained on the development sleeve and is controlled to an appropriate amount by a controlling blade (doctor blade) whose tip is maintained to be apart by a predetermined distance from the outer surface of the development sleeve (51). The developer is conveyed a developing region where an image bearing member (1) and the development sleeve (51) face each other.

The material for a cylinder of the development sleeve for retaining a developer is preferably non-magnetic metals such as aluminum. Also, the surface of the cylinder is preferably treated through, for example, blasting so as to have concave and convex portions.

With reference to the drawing, next will be described the developing gap between the image bearing member and the development sleeve.

Figure 8:
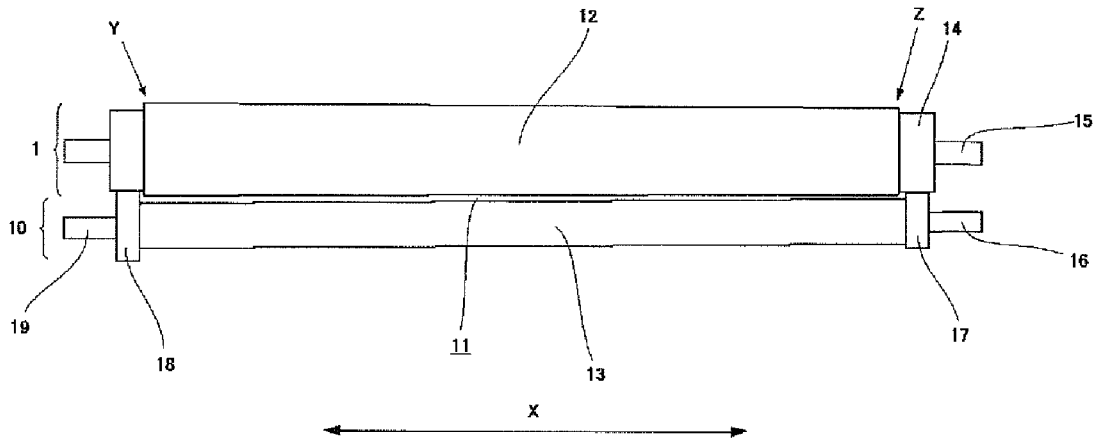
FIG. 8 is a schematic view of a developing gap in the present invention.

FIG. 8 is a schematic view of the developing gap, which is defined as a developing gap 11 between an image bearing member 1 and a development sleeve 10.

The image bearing member 1 has a conductive cylindrical support 14 containing an organic photoconductive layer 12 therearound, and is rotatably supported by an image bearing member rotational axis 15. Here, the thickness of the organic photoconductive layer 12 monotonically decreases in a direction X along the rotational axis of the image bearing member 1 from one end (Y) to the other end (Z) of the image bearing member 1.

Also, the development sleeve 10 has a development sleeve cylinder 13 therearound. The development sleeve is disposed so as to be capable of coming into contact with the conductive cylindrical support 14 of the image bearing member 1, by a developing gap-adjusting roller (large) 18 having a larger diameter and a developing gap-adjusting roller (small) having a smaller diameter 17 which respectively correspond to the one end (Y) and the other end (Z). Further, the development sleeve is rotatably supported by an internal magnet fixing axis 19 disposed on the one end (Y) side and a development sleeve-rotating axis 16 disposed on the other end (Z) side. Here, the developing gap 11 is adjusted so that it becomes narrower from the one end (Y) of the image bearing member 1 where the organic photoconductive layer 12 is thicker to the other end (Z) of the image bearing member where the organic photoconductive layer 12 is thinner.

Notably, the developing gap 11 can be easily adjusted by appropriately bringing the developing gap-adjusting roller (small) 17 used on the one end side and the developing gap-adjusting roller (large) 18 used on the other end side into contact with the conductive cylindrical support 14 of the image bearing member 1.

In FIG. 8, the gap width of the developing gap 11 and the thickness of the organic photoconductive layer 12 are schematically enlarged for the understanding of the present invention.

—Developer—

The developer is not particularly limited and may be appropriately selected depending on the purpose. It is preferably a two-component developer containing a toner and a carrier.

The toner is not particularly limited and may be appropriately selected depending on the purpose. It preferably has an average circularity of 0.93 to 1.00, more preferably 0.95 to 0.99, which is an average value of circularities SRs each being calculated using the following Equation 2.

The average circularity is indicative of the degree of irregularities of each toner particle. When the toner particle is perfectly spherical, the circularity is 1.00. Meanwhile, the more complex the surface shape of the toner particle becomes, the smaller the circularity becomes.

Circularity *SR*=circumferential length of circle having the same area as projected particle area/circumferential length of projected particle image Equation 2

When the average circularity is in the range of 0.93 to 1.00, the surface of toner particles is smooth, and the area where the toner particles are in contact with one another and the area where the toner particles are in contact with the photoconductor are small, so that superior transferability can be obtained. The toner particles do not have corners, so that the torque with which a developer is agitated in a developing device can be reduced and the driving for agitation can be stabilized; therefore, abnormal images do not arise. Also, since the toner particles which form dots do not include angular toner particles, pressure is uniformly applied to the entire toner particles when they are transferred and pressed against a transfer medium, and thus absence of toner particles hardly arises during the transfer. Since the toner particles are not angular, the toner particles themselves have little abrasive power, thus not damaging or abrading the surface of the image bearing member.

The circularity SR can be measured using a flow-type particle image analyzer (FPIA-1000, manufactured by Toa Medical Electronics Co., Ltd.).

First, 0.1 mL to 0.5 mL of a surfactant (preferably alkylbenzene sulfonate) is added as a dispersant into 100 mL to 150 mL of water in a container, from which solid impurities have previously been removed. Then, about 0.1 g to about 0.5 g of a measurement sample (toner) is added. The suspension in which the sample is dispersed is subjected to dispersing treatment by an ultrasonic dispersing device for about 1 min to about 3 min, and the concentration of the dispersed liquid is adjusted such that the number of particles of the sample is 3,000 per microliter to 10,000 per microliter. In this state, the shape and particle size of the toner are measured using the analyzer.

The weight average particle diameter (D4) of the toner is not particularly limited and may be appropriately selected depending on the purpose. It is preferably 3 μm to 10 μm, more preferably 4 μm to 8 μm. When the weight average particle diameter falls within this range, superior dot reproducibility can be obtained because the toner contains particles which are sufficiently small in diameter with respect to fine dots of a latent image. When the weight average particle diameter (D4) is less than 3 μm, a phenomenon easily arises in which there is a decrease in transfer efficiency and blade cleaning capability. When it is greater than 10 μm, it is difficult to reduce raggedness of lines and letters.

Also, the ratio (D4/D1) of the weight average particle diameter (D4) of the toner to a number average particle diameter (D1) of the toner preferably falls within a range of 1.00 to 1.40, more preferably 1.00 to 1.30. The closer the value of the ratio (D4/D1) is to 1, the sharper the particle size distribution of the toner is. When the ratio (D4/D1) falls within a range of 1.00 to 1.40, differences in particle diameter of the toner do not cause particles to be ununiformly used for image formation, so that the image quality can be excellently stabilized. In addition, since the particle size distribution of the toner is sharp, the distribution of the frictional charge amount is also sharp, and thus the occurrence of fogging can be reduced. When the toner has a uniform particle diameter, a latent image is developed such that particles are accurately and neatly arranged on dots of the latent image, and thus superior dot reproducibility can be obtained.

The weight average particle diameter (D4) of the toner and the particle size distribution of the toner can be measured with, for example, the Coulter counter method.

Examples of a measuring device for measuring the particle size distribution of toner particles in accordance with the Coulter counter method include COULTER COUNTER TA-II and COULTER MULTISIZER II (both of which are manufactured by Coulter Corporation).

The specific measurement procedure is given below.

First, 0.1 mL to 5 mL of a surfactant (preferably alkylbenzene sulfonate) is added as a dispersant into 100 mL to 150 mL of an electrolytic aqueous solution. Here, the electrolytic aqueous solution means an approximately 1% NaCl aqueous solution prepared using a primary sodium chloride. For the preparation, ISOTON-II (manufactured by Coulter Corporation) can be used, for example. Then, 2 mg to 20 mg of a measurement sample (toner) is added. The electrolytic aqueous solution in which the sample is suspended is subjected to dispersing treatment by an ultrasonic dispersing device for about 1 min to about 3 min, then the volume of the toner or toner particles and the number of the toner particles are measured by the measuring device, using apertures of 100 μm each, and the volume distribution and the number distribution are calculated. The weight average particle diameter (D4) and the number average particle diameter (D1) of the toner can be calculated from these distributions obtained.

As channels in the measuring device, the following 13 channels are used, and particles having diameters which are equal to or greater than 2.00 μm, and less than 40.30 μm are targeted: a channel of 2.00 μm or greater, and less than 2.52 μm; a channel of 2.52 μm or greater, and less than 3.17 μm; a channel of 3.17 μm or greater, and less than 4.00 μm: a channel of 4.00 μm or greater, and less than 5.04 μm; a channel of 5.04 μm or greater, and less than 6.35 μm: a channel of 6.35 μm or greater, and less than 8.00 μm; a channel of 8.00 μm or greater, and less than 10.08 μm; a channel of 10.08 μm or greater, and less than 12.70 μm: a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

Such a substantially spherical toner can be produced by cross-linking and/or elongating a toner composition containing a polyester prepolymer which has a nitrogen atom-containing functional group, a polyester, a colorant and a releasing agent in the presence of fine resin particles in an aqueous medium. The thus-produced toner makes it possible to reduce hot offset when the toner surface is hardened, and thus to restrain smears from being left on a fixing device and appearing on images.

Examples of prepolymers made of modified polyester resins include isocyanate group-containing polyester prepolymers (A). Examples of compounds which elongate and/or cross-link with the prepolymers include amines (B).

Examples of the isocyanate group-containing polyester prepolymers (A) include a compound obtained through reaction between a polyisocyanate (3) and a polyester which is a polycondensate of a polyol (1) and a polycarboxylic acid (2) and contains an active hydrogen group. Examples of the active hydrogen group of the polyester include a hydroxyl group (alcoholic hydroxyl groups and phenolic hydroxyl groups), an amino group, a carboxyl group and a mercapto group, with alcoholic hydroxyl groups being particularly preferred.

Examples of the polyol (1) include diols (1-1) and trihydric or higher polyols (1-2), and it is preferable to use any of the diols (1-1) alone, or mixtures each composed of any of the diols (1-1) and a small amount of any of the trihydric or higher polyols (1-2).

Examples of the diols (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Among these, preferred are alkylene glycols having 2 to 12 carbon atoms, and alkylene oxide adducts of bisphenols; more preferred are alkylene oxide adducts of bisphenols, and combinations of the alkylene oxide adducts and alkylene glycols having 2 to 12 carbon atoms.

Examples of the trihydric or higher polyols (1-2) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polycarboxylic acid (2) include dicarboxylic acids (2-1) and trivalent or higher polycarboxylic acids (2-2), and it is preferable to use any of the dicarboxylic acids (2-1) alone, or mixtures each composed of any of the dicarboxylic acids (2-1) and a small amount of any of the trivalent or higher polycarboxylic acids (2-2).

Examples of the dicarboxylic acids (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Among these, particularly preferred are alkenylene dicarboxylic acids having 4 to 20 carbon atoms and aromatic dicarboxylic acids having 8 to 20 carbon atoms.

Examples of the trivalent or higher polycarboxylic acids (2-2) include aromatic polycarboxylic acids (trimellitic acid, pyromellitic acid, etc.) having 9 to 20 carbon atoms. Additionally, the polycarboxylic acid (2) may be selected from acid anhydrides or lower alkyl esters (methyl ester, ethyl ester, isopropyl ester, etc.) of the above-mentioned compounds and reacted with the polyol (1).

As for the ratio of the polyol (1) to the polycarboxylic acid (2), the equivalence ratio [OH]/[COOH] of the hydroxyl group [OH] to the carboxyl group [COOH] is preferably 2/1 to 1/1, more preferably 1.5/1 to 1/1, particularly preferably 1.3/1 to 1.02/1.

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates ($\alpha,\alpha,\alpha',\alpha'$-tetramethylxylylene diisocyanate, etc.); isocyanurates; and the polyisocyanates blocked with phenol derivatives, oximes, caprolactam, etc. These may be individually or in combination.

As for the ratio of the polyisocyanate (3) to the polyester, the equivalence ratio [NCO]/[OH] of the isocyanate group [NCO] to the hydroxyl group [OH] of the hydroxyl group-containing polyester is preferably 5/1 to 1/1, more preferably 4/1 to 1.2/1, particularly preferably 2.5/1 to 1.5/1. When the equivalence ratio [NCO]/[OH] is greater than 5, there is a decrease in low-temperature fixing property. When the isocyanate group [NCO] is less than 1 in molar ratio, the amount of urea contained in the modified polyester is small, so that there is a decrease in resistance to hot offset.

The amount of components of the polyisocyanate (3) contained in the isocyanate-terminated prepolymer (A) is preferably 0.5% by mass to 40% by mass, more preferably 1% by mass to 30% by mass, particularly preferably 2% by mass to 20% by mass. When the amount is less than 0.5% by mass, there is a decrease in resistance to hot offset and there is a disadvantage in achieving a favorable balance between heat-resistant storageability and low-temperature fixing property. When the amount is greater than 40% by mass, there may be a decrease in low-temperature fixing property.

The number of isocyanate groups contained per molecule in the isocyanate group-containing prepolymer (A) is preferably 1 or more, more preferably 1.5 to 3 on average, particularly preferably 1.8 to 2.5 on average. When the number thereof per molecule is less than 1 on average, the molecular weight of a urea-modified polyester is low, and thus there may be a decrease in resistance to hot offset.

Examples of the amines (B) include diamines (B1), trivalent or higher polyamines (B2), amino alcohols (B3), amino mercaptans (B4), amino acids (B5), and compounds (B6) obtained by blocking amino groups of (B1) to (B5).

Examples of the diamines (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.).

Examples of the trivalent or higher polyamines (B2) include diethylenetriamine and triethylenetetramine.

Examples of the amino alcohols (B3) include ethanolamine and hydroxyethylaniline. Examples of the amino mercaptans (B4) include aminoethyl mercaptan and aminopropyl mercaptan.

Examples of the amino acids (B5) include aminopropionic acid and aminocaproic acid.

Examples of the compounds (B6) include oxazoline compounds and ketimine compounds derived from the amines of (B1) to (B5) and ketones (acetone, methy ethyl ketone, methyl isobutyl ketone, etc.).

Among these amines (B), preferred are the diamines (B1), and mixtures each composed of any of the diamines (B1) and a small amount of any of the trivalent or higher polyamines (B2).

Further, an elongation terminator may, if necessary, be used so as to adjust the molecular weight of a urea-modified polyester.

Examples of the elongation terminator include monoamines (diethylamine, dibutylamine, butylamine, laurylamine, etc.), and compounds (ketimine compounds) obtained by blocking the monoamines.

As for the proportion of the amine (B), the equivalence ratio [NCO]/[NHx] of the isocyanate group [NCO] in the isocyanate group-containing prepolymer (A) to the amino group [NHx] in the amine (B) is preferably 1/2 to 2/1, more preferably 1.5/1 to 1/1.5, particularly preferably 1.2/1 to 1/1.2. When the equivalence ratio [NCO]/[NHx] is greater than 2 or less than ½, the molecular weight of a urea-modified polyester (i) is low, and thus there is a decrease in resistance to hot offset.

The urea-modified polyester (i) may contain a urethane bond as well as a urea bond. The molar ratio of the amount of the urea bond to the amount of the urethane bond is preferably 100/0 to 10/90, more preferably 80/20 to 20/80, particularly preferably 60/40 to 30/70. When the urea bond is less than 10% in molar ratio, there may be a decrease in resistance to hot offset.

By the above-mentioned reactions, a modified polyester, particularly the urea-modified polyester (i), used for the toner can be produced. The urea-modified polyester (i) is produced by a one-shot method or a prepolymer method. The weight average molecular weight of the urea-modified polyester (i) is preferably 10,000 or greater, more preferably 20,000 to 10,000,000, particularly preferably 30,000 to 1,000,000. When it is less than 10,000, there may be a decrease in resistance to hot offset.

The number average molecular weight of the urea-modified polyester is not particularly limited when the below-mentioned unmodified polyester (ii) is additionally used; it may be such a number average molecular weight as helps obtain the above-mentioned weight average molecular weight. When the urea-modified polyester (i) is solely used, its number average molecular weight is preferably 20,000 or less, more preferably 1,000 to 10,000, particularly preferably 2,000 to 8,000. When it is greater than 20,000, there may be a decrease in low-temperature fixing property and, if the urea-modified polyester (1) is used in a full-color image forming apparatus, there may be a decrease in glossiness.

Also, instead of solely using the urea-modified polyester (i), an unmodified polyester (ii) may be additionally used as a binder resin component together with the urea-modified polyester (i). The use of the unmodified polyester (ii) together with the urea-modified polyester (i) is preferable to the use of the urea-modified polyester (i) alone because there is an increase in low-temperature fixing property and, if used in a full-color image forming apparatus, there is an increase in glossiness.

Examples of the unmodified polyester (ii) include a polycondensate of a polyol (1) and a polycarboxylic acid (2) similar to the components of the urea-modified polyester (i), and suitable examples thereof are also similar to those suitable for the urea-modified polyester (i).

The polyester (ii) does not necessarily have to be an unmodified polyester and may be a polyester modified with a chemical bond other than urea bond, for example urethane bond.

It is desirable in terms of low-temperature fixing property and resistance to hot offset that the urea-modified polyester (i) and the polyester (ii) be compatible with each other at least partially.

Accordingly, it is desirable that the urea-modified polyester (i) and the polyester (ii) have similar compositions. When the polyester (ii) is used, the mass ratio of the polyester (i) to the polyester (ii) is preferably 5/95 to 80/20, more preferably 5/95 to 30/70, still more preferably 5/95 to 25/75, particularly preferably 7/93 to 20/80. When the mass ratio of the polyester (i) is less than 5% by mass, there is a decrease in resistance to hot offset and there may be a disadvantage in achieving a favorable balance between heat-resistant storageability and low-temperature fixing property.

The peak molecular weight of the polyester (ii) is preferably 1,000 to 30,000, more preferably 1,500 to 10,000, particularly preferably 2,000 to 8,000. When it is less than 1,000, there may be a decrease in heat-resistant storageability. When it is greater than 10,000, there may be a decrease in low-temperature fixing property.

The hydroxyl value of the polyester (ii) is preferably 5 or greater, more preferably 10 to 120, particularly preferably 20 to 80. When the hydroxyl value is less than 5, there is a disadvantage in achieving a favorable balance between heat-resistant storageability and low-temperature fixing property.

The acid value of the polyester (ii) is preferably 1 to 30, more preferably 5 to 20. With such an acid value, the polyester (ii) tends to be easily negatively charged.

The glass transition temperature (Tg) of the binder resin is preferably 50° C. to 70° C., more preferably 55° C. to 65° C. If it is lower than 50° C., blocking worsens when the toner is stored at a high temperature. If it is higher than 70° C., the low-temperature fixing property is insufficient. By virtue of the presence of the urea-modified polyester together with the unmodified polyester, the toner tends to be superior in heat-resistant storageability to known polyester toners even if the glass transition temperature is low.

As for the storage elastic modulus of the binder resin, the temperature (TG') at which it is 10,000 dyne/cm$^2$, at a measurement frequency of 20 Hz, is preferably 100° C. or higher, more preferably 110° C. to 200° C. When the temperature (TG') is lower than 100° C., there may be a decrease in resistance to hot offset.

As for the viscosity of the binder resin, the temperature (Tη) at which it is 1,000 P, at a measurement frequency of 20 Hz, is preferably 180° C. or lower, more preferably 90° C. to 160° C. When the temperature (Tη) is higher than 180° C., there is a decrease in low-temperature fixing property. Accordingly, it is desirable in terms of a balance between low-temperature fixing property and resistance to hot offset that TG' be higher than Tη. In other words, the difference (TG'−Tη) between TG' and Tη is preferably 0° C. or greater, more preferably 10° C. or greater, particularly preferably 20° C. or greater. The upper limit of the difference is not particularly limited. Also, in terms of a balance between heat-resistant storageability and low-temperature toner-fixing capability, the difference between Tη and Tg is preferably 0° C. to 100° C., more preferably 10° C. to 90° C., particularly preferably 20° C. to 80° C.

The binder resin can be produced by, for example, the following method.

First, a polyol (1) and a polycarboxylic acid (2) are heated to a temperature of 150° C. to 280° C. in the presence of a known esterifying catalyst such as tetrabutoxy titanate or dibutyltin oxide, and then water produced is distilled away with the pressure being reduced if necessary, whereby a hydroxyl group-containing polyester is obtained. Subsequently, the polyester is reacted with a polyisocyanate (3) at a temperature of 40° C. to 140° C. so as to obtain an isocyanate group-containing prepolymer (A). Further, the prepolymer (A) is reacted with an amine (B) at a temperature of 0° C. to 140° C. so as to obtain a urea-modified polyester. When the polyester is reacted with the polyisocyanate (3) and when the prepolymer (A) is reacted with the amine (B), a solvent may be used if necessary.

Examples of usable solvents include aromatic solvents (toluene, xylene, etc.), ketones (acetone, methyl ethyl ketone, methyl isobutyl ketone, etc.), esters (ethyl acetate, etc.), amides (dimethylformamide, dimethylacetamide, etc.) and ethers (tetrahydrofuran, etc.), which are inactive to the polyisocyanate (3).

In the case where a polyester (ii) which is not modified with a urea bond is additionally used, the polyester (ii) is produced in a manner similar to the production of the hydroxyl group-containing polyester, and the polyester (ii) is dissolved and mixed in a solution of the above-mentioned urea-modified polyester (i) in which reaction has been completed.

The toner can be produced by the following method. It should, however, be noted that other methods may be employed instead.

The toner may be formed in an aqueous medium through reaction between the amine (B) and a dispersion element made of the isocyanate group-containing prepolymer (A) or by using the urea-modified polyester (i) produced in advance. As a method for stably forming the dispersion element made of the prepolymer (A) and/or the urea-modified polyester (i) in the aqueous medium, there is, for example, a method of adding a toner material composition which contains the prepolymer (A) or the urea-modified polyester (i) into the aqueous medium and dispersing the composition by shearing force.

The prepolymer (A) and other toner components (hereinafter referred to as "toner materials") such as a colorant, a colorant master batch, a releasing agent, a charge controlling agent and an unmodified polyester resin may be mixed together when the dispersion element is formed in the aqueous medium; it is, however, more preferred to mix the toner materials together in advance, then add and disperse the mixture into the aqueous medium. Also in the present invention, the other toner materials such as a colorant, a releasing agent and a charge controlling agent do not necessarily have to be mixed when the particles are formed in the aqueous medium; the other toner materials may be added after the particles have been formed. For instance, a colorant may be added in accordance with a known dyeing method after particles not containing a colorant have been formed.

The aqueous medium used may be composed solely of water or composed of water and a solvent miscible with water. Examples of the water-miscible solvent include alcohols (methanol, isopropanol, ethylene glycol, etc.), dimethylformamide, tetrahydrofuran, cellusolves (methyl cellusolve, etc.) and lower ketones (acetone, methyl ethyl ketone, etc.).

The amount of the aqueous medium used is preferably 50 parts by mass to 2,000 parts by mass, more preferably 100 parts by mass to 1,000 parts by mass, per 100 parts by mass of the toner composition which contains the prepolymer (A) and/or the urea-modified polyester (i). When the amount is less than 50 parts by mass, the toner composition is in a poorly dispersed state, and thus toner particles having a predetermined diameter cannot be obtained. Whereas when the amount is greater than 2,000 parts by mass, it is not preferred from an economical point of view.

Additionally, a dispersant may be used if necessary. Use of a dispersant is preferable in that the particle size distribution becomes sharper and the dispersion can be stabilized.

Although not particularly limited, the dispersing method may be selected from known methods such as low-speed shearing dispersion, high-speed shearing dispersion, frictional dispersion, high-pressure jet dispersion and ultrasonic dispersion.

To make the dispersion element have a particle diameter of 2 μm to 20 μm, high-speed shearing dispersion is preferable.

In the case where a high-speed shearing dispersing machine is used, the rotational speed is, although not particularly limited, preferably 1,000 rpm to 30,000 rpm, more preferably 5,000 rpm to 20,000 rpm. Although not particularly limited, the length of time for which the dispersion lasts is preferably 0.1 min to 5 min when a batch method is employed. The temperature at the time of dispersion is generally 0° C. to 150° C., more preferably 40° C. to 98° C. High temperatures are preferable in that the dispersion element made of the prepolymer (A) and/or the urea-modified polyester (i) is low in viscosity and thus the dispersion can be facilitated.

As to a process of synthesizing the urea-modified polyester (i) from the prepolymer (A), the amine (B) may be added for reaction, before the toner composition is dispersed in the aqueous medium; alternatively, the amine (B) may be added after the toner composition has been dispersed in the aqueous medium, thus allowing reaction to occur from particle interfaces. In this case, the urea-modified polyester may be preferentially formed on the surface of the toner produced, and a concentration gradient may be thus provided inside toner particles.

Preferably, a dispersant is used in the above-reaction, if necessary.

The dispersant is not particularly limited and may be appropriately selected depending on the purpose. Examples thereof include a surfactant, an inorganic compound dispersant sparingly soluble in water, and a polymeric protective colloid. These may be used individually or in combination. Among them, a surfactant is preferably used.

Examples of the surfactant include an anionic surfactant, a cationic surfactant, a nonionic surfactant and an amphoteric surfactant.

Examples of the anionic surfactant include alkylbenzene sulfonates, α-olefin sulfonates and phosphoric acid esters, with fluoroalkyl group-containing surfactants being preferred. Examples of the fluoroalkyl group-containing anionic surfactants include fluoroalkyl carboxylic acids having 2 to 10 carbon atoms, and metal salts thereof, disodium perfluorooctanesulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl (C4 to C12) sulfonic acids and metal salts thereof, perfluorooctanesulfonic acid diethanolamide, N-propyl-N-(2-hydroxyethyl)perfluorooctanesulfonamide, perfluoroalkyl (C6 to C10) sulfonamide propyltrimethylammonium salts, perfluoroalkyl (C6 to C10)-N-ethylsulfonylglycine salts and monoperfluoroalkyl (C6 to C16) ethyl phosphoric acid esters. Examples of commercially available fluoroalkyl group-containing surfactants include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFAC F-110, F-120, F-113, F-191, F-812 and F-833 (produced by Dainippon Ink And Chemicals, Incorporated); ECTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of the cationic surfactant include amine salt-based surfactants and quaternary ammonium salt-based cationic surfactants. Examples of the amine salt-based surfactants include alkylamine salts, aminoalcohol fatty acid derivatives, polyamine fatty acid derivatives and imidazoline. Examples of the quaternary ammonium salt-based cationic surfactants include alkyltrimethyl ammonium salts, dialkyl dimethyl ammonium salts, alkyl dimethyl benzyl ammonium salts, pyridinium salts, alkyl isoquinolinium salts and benzetonium chloride. Further examples of the cationic surfactants include fluoroalkyl group-containing aliphatic primary, secondary or tertiary amine acids, aliphatic quaternary ammonium salts such as perfluoroalkyl (C6 to C10) sulfonamide propyltrimethylammonium salts, benzalkonium salts, benzetonium chloride, pyridinium salts and imidazolinium salts. Examples of commercially available cationic surfactants include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFAC F-150 and F-824 (produced by Dainippon Ink And Chemicals, Incorporated), ECTOP EF-132 (produced by Tochem Products Co., Ltd.), and FTERGENT F-300 (produced by NEOS COMPANY LIMITED).

Examples of the nonionic surfactant include fatty acid amide derivatives and polyhydric alcohol derivatives.

Examples of the amphoteric surfactant include alanine, dodecyldi(aminoethyl)glycine, di(octylaminoethyl)glycine and N-alkyl-N,N-dimethylammoniumbetaine.

Examples of the inorganic compound dispersant sparingly soluble in water include tricalcium phosphate, calcium carbonate, titanium oxide, colloidal silica and hydroxyappetite.

Examples of the polymeric protective colloid include acids, hydroxyl group-containing (meth)acrylic monomers, vinyl alcohol and ethers of vinyl alcohol, esters of carboxyl group-containing compounds and vinyl alcohol, amide compounds and methylol compounds thereof, chlorides, homopolymers and copolymers of, for example, compounds containing a nitrogen atom or a nitrogen-containing heterocyclic ring, polyoxyethylene-based compounds and celluloses.

Examples of the acids include acrylic acid, methacrylic acid, α-cyanoacrylic acid, α-cyanomethacrylic acid, itaconic acid, crotonic acid, fumaric acid, maleic acid and maleic anhydride.

Examples of the hydroxyl group-containing (meth)acrylic monomers include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide.

Examples of the ethers of vinyl alcohol include vinyl methyl ether, vinyl ethyl ether and vinyl propyl ether.

Examples of the esters of carboxyl group-containing compounds and vinyl alcohol include vinyl acetate, vinyl propionate and vinyl butyrate.

Examples of the amide compounds and methylol compounds thereof include acrylamide, methacrylamide, diacetone acrylamide, and methylol compounds thereof. Examples of the chlorides include acrylic acid chloride and methacrylic acid chloride.

Examples of the homopolymers and copolymers of, for example, compounds containing a nitrogen atom or a nitrogen-containing heterocyclic ring include those of vinyl pyridine, vinyl pyrolidone, vinyl imidazole and ethyleneimine.

Examples of the polyoxyethylene-based compounds include polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester.

Examples of the celluloses include methyl cellulose, hydroxyethyl cellulose and hydroxypropyl cellulose.

In the preparation of the dispersion, a dispersion stabilizer may be used. Examples thereof include a substance soluble in acid and/or alkali, such as a calcium phosphate salt.

When the dispersion stabilizer (e.g., calcium phosphate salt) is used, it is dissolved in an acid; e.g., hydrochloric acid, then is removed from fine particles by, for example, washing with water. Besides, its removal is enabled by a process such as decomposition brought about by an enzyme.

In the preparation of the dispersion, a catalyst for the cross-linking/elongating reaction can be used. Examples thereof include dibutyltin laurate and dioctyltin laurate.

Further, to reduce the viscosity of the toner composition, a solvent may be used in which the urea-modified polyester (i) and/or the prepolymer (A) are/is soluble. Use of the solvent is preferable in that the particle size distribution becomes sharper. In addition, the solvent is preferably volatile since its removal can be readily performed.

Examples of the solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone. These may be used individually or in combination. Among them, preferred are aromatic solvents such as toluene and xylene, and halogenated hydrocarbons such as methylene chloride, 1,2-dichloroethane, chloroform and carbon tetrachloride; and more preferred are aromatic solvents such as toluene and xylene.

The amount of the solvent used is preferably 0 parts by mass to 300 parts by mass, more preferably 0 parts by mass to 100 parts by mass, particularly preferably 25 parts by mass to 70 parts by mass, per 100 parts by mass of the prepolymer (A). In the case where the solvent is used, it is removed by heating under normal or reduced pressure after elongation and/or cross-linkage.

The length of time for which the elongation and/or the cross-linkage last(s) is selected according to the reactivity between the isocyanate group structure of the prepolymer (A) and the amine (B). In general, it is preferably 10 min to 40 hr, more preferably 2 hr to 24 hr.

The reaction temperature is preferably 0° C. to 150° C., more preferably 40° C. to 98° C. Additionally, a known catalyst may be used if necessary. Specific examples thereof include dibutyltin laurate and dioctyltin laurate.

To remove an organic solvent from the emulsified dispersion obtained, a method can be employed in which the entire system is gradually increased in temperature and the organic solvent in droplets is completely removed by evaporation. Alternatively, by spraying the emulsified dispersion into a dry atmosphere and completely removing a water-insoluble organic solvent in droplets, fine toner particles can be formed, and also, an aqueous dispersant can be removed by evaporation.

Generally, examples of the dry atmosphere into which the emulsified dispersion is sprayed include gases such as air, nitrogen, carbonic acid gas and combustion gas which have been heated, especially flow of gasses heated to a temperature higher than or equal to the boiling point of the solvent used that has the highest boiling point. The desired effects can be obtained by a short time process with a spray dryer, a belt dryer, a rotary kiln or the like.

In the case where there is a wide particle size distribution at the time of emulsification and dispersion, and washing and drying processes are carried out with the particle size distribution kept unchanged, it is possible to adjust the particle size distribution such that particles are classified according to a desired particle size distribution.

As to the classification, fine particles can be removed by a cyclone separator, a decanter, a centrifuge, etc. in liquid. The classification may, of course, be carried out after particles have been obtained as powder through drying; nevertheless, it is desirable in terms of efficiency that the classification be carried out in liquid. Unnecessary fine or coarse particles produced may be returned to a kneading process again so as to be used for formation of particles. In this case, the fine or coarse particles may be in a wet state.

It is desirable that the dispersant used be removed from the obtained dispersion as much as possible and at the same time as the classification.

By mixing the obtained dried toner powder with different particles such as releasing agent fine particles, charge controlling fine particles, fluidizer fine particles and colorant fine particles and mechanically impacting the mixed powder, the different particles are fixed to and fused with the particle surface and thus it is possible to prevent detachment of the different particles from the surface of the composite particles obtained.

As specific means of performing the foregoing, there are, for example, (1) a method of impacting the mixture, using a blade which rotates at high speed, and (2) a method of pouring the mixture into a high-speed gas flow, accelerating the speed of the mixture and allowing particles to collide with one another or composite particles to collide with a certain plate. Examples of apparatuses for performing the foregoing include apparatuses in which the pulverization air pressure is reduced, made by modifying I-TYPE MILL (manufactured by Nippon Pneumatic Mfg. Co., Ltd.) and ANGMILL (manufactured by Hosokawa Micron Group); HYBRIDIZATION SYSTEM (manufactured by NARA MACHINERY CO., LTD.); KRYPTRON SYSTEM (manufactured by Kawasaki Heavy Industries, Ltd.); and automatic mortars.

Examples of the colorant used for the toner include pigments and dyes conventionally used as colorants for toners. Specific examples thereof include carbon black, lamp black, iron black, ultramarine, nigrosine dyes, aniline blue, phthalocyanine blue, phthalocyanine green, Hansa Yellow G, Rhodamine 6C Lake, chalco oil blue, chrome yellow, quinacridone red, benzidine yellow and rose bengal. These may be used individually or in combination.

Further, if necessary, magnetic components, for example iron oxides such as ferrite, magnetite and maghemite, metals such as iron, cobalt and nickel, and alloys composed of these and other metals, may be included individually or in combination in toner particles in order for the toner particles themselves to have magnetic properties. Also, these components may be used (also) as colorant components.

Also, the number average particle diameter of the colorant in the toner is preferably 0.5 μm or less, more preferably 0.4 μm or less, particularly preferably 0.3 μm or less. When the number average particle diameter is greater than 0.5 μm, the dispersibility of the pigment is insufficient, and thus favorable transparency cannot be obtained in some cases. When the colorant has a very small number average particle diameter of less than 0.1 μm, it is far smaller than the half wavelength of visible light; thus, it is thought that the colorant does not have an adverse effect on light-reflecting and -absorbing properties.

Therefore, colorant particles which are less than 0.1 μm in diameter contribute to favorable color reproducibility and transparency of an OHP sheet with a fixed image.

Meanwhile, when there are many colorant particles which are greater than 0.5 μm in number average particle diameter, transmission of incident light is disturbed and/or the incident light is scattered, and thus a projected image on an OHP sheet tends to decrease in brightness and vividness.

Also, the presence of many colorant particles which are greater than 0.5 μm in diameter is not favorable because the colorant particles easily detach from the toner particle surface, causing problems such as fogging, smearing of the drum and cleaning failure.

It should be particularly noted that colorant particles which are greater than 0.7 μm in number average particle diameter preferably occupy 10% by number or less, more preferably 5% by number or less, of all colorant particles.

Also, by kneading the colorant together with part or all of a binder resin in advance with the addition of a wetting liquid, the colorant and the binder resin are sufficiently attached to each other at an early stage, the colorant is effectively dispersed in toner particles in a subsequent toner producing process, the dispersed particle diameter of the colorant becomes small, and thus more favorable transparency can be obtained.

For the binder resin kneaded together with the colorant in advance, any of the resins shown above as examples of binder resins for the toner can be used without the need to change it; it should, however, be noted that the binder resin is not limited to the resins.

As a specific method of kneading a mixture of the colorant and the binder resin in advance with the addition of the wetting liquid, there is, for example, a method in which the colorant, the binder resin and the wetting liquid are mixed together using a blender such as a Henschel mixer, then the obtained mixture is kneaded at a temperature lower than the melting temperature of the binder resin, using a kneading machine such as a two-roll machine or three-roll machine, and a sample is thus obtained.

For the wetting liquid, an ordinary one may be used, considering the solubility of the binder resin and the wettability thereof with the colorant; water and organic solvents such as acetone, toluene and butanone are favorable in terms of the colorant's dispersibility. Among them, use of water is particularly favorable in view of care for the environment and maintenance of the colorant's dispersion stability in the subsequent toner producing process.

With this production method, colorant particles contained in the obtained toner are small in diameter, and also, the particles are in a highly uniform dispersed state, so that the color reproducibility of an image projected by an OHP can be further improved.

Preferably, a releasing agent is additionally incorporated into the toner along with the binder resin and the colorant.

The releasing agent is not particularly limited and may be appropriately selected from known releasing agents. Examples thereof include polyolefin waxes (polyethylene wax, polypropylene wax, etc.), long-chain hydrocarbons (paraffin wax, SASOLWAX, etc.), and carbonyl group-containing waxes, with carbonyl group-containing waxes being particularly preferred.

Examples of the carbonyl group-containing waxes include polyalkanoic acid esters (carnauba wax, montan wax, trimethylolpropane tribehenate, pentaerythritol tetrabehenate, pentaerythritol diacetate dibehenate, glycerin tribehenate, 1,18-octadecanediol distearate, etc.), polyalkanol esters (tristearyl trimellitate, distearyl maleate, etc.), polyalkanoic acid amides (ethylenediamine dibehenyl amide, etc.), polyalkylamides (trimellitic acid tristearyl amide, etc.), and dialkyl ketones (distearyl ketone, etc.), with polyalkanoic acid esters being particularly preferred.

The melting point of the releasing agent is preferably 40° C. to 160° C., more preferably 50° C. to 120° C., particularly preferably 60° C. to 90° C. Waxes which are lower than 40° C. in melting point have an adverse effect on heat-resistant storageability, and waxes which are higher than 160° C. in melting point are likely to cause cold offset when toner is fixed at a low temperature.

The melt viscosity of each wax is preferably 5 cps to 1,000 cps, more preferably 10 cps to 100 cps, when measured at a temperature higher than the melting point by 20° C. Waxes which are higher than 1,000 cps in melt viscosity are not much effective in improving low-temperature fixing property and resistance to hot offset.

The amount of wax contained in the toner is preferably 0% by mass to 40% by mass, more preferably 3% by mass to 30% by mass.

Additionally, to adjust the charged amount of the toner and allow toner particles to rise quickly upon charging, a charge controlling agent may be contained in the toner if necessary. Here, if a colored material is used as the charge controlling agent, there is a change in color, so that use of a material which is colorless or whitish is preferable.

The charge controlling agent is not particularly limited and may be appropriately selected from known charge controlling agents. Examples thereof include triphenylmethane-based dyes, molybdic acid chelate pigments, rhodamine-based dyes, alkoxy amines, quaternary ammonium salts (including fluorine-modified quaternary ammonium salts), alkylamides, phosphorus and compounds thereof, tungsten and compounds thereof, fluorine-based activating agents, metal salts of salicylic acid and metal salts of salicylic acid derivatives.

The charge controlling agent may be a commercially available product. Examples thereof include Bontron P-51 as a quaternary ammonium salt, E-82 as an oxynaphthoic acid-based metal complex, E-84 as a salicylic acid-based metal complex, and E-89 as a phenolic condensate (which are produced by Orient Chemical Industries); TP-302 and TP-415 as quaternary ammonium salt molybdenum complexes (which are produced by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (which are produced by Hoechst); LRA-901, and LR-147 as a boron complex (which are produced by Japan Carlit Co., Ltd.); quinacridone, azo-based pigments; and polymeric compounds containing functional groups such as sulfonic acid group, carboxyl group and quaternary ammonium salt.

The amount of the charge controlling agent used is determined according to the type of the binder resin, the presence or absence of additive(s), and the toner producing method including the dispersing method and so not unequivocally limited; however, the amount is preferably falls within a range of 0.1 parts by mass to 10 parts by mass, more preferably falls within a 0.2 parts by mass to 5 parts by mass, per 100 parts by mass of the binder resin. When the amount is greater than 10 parts by mass, the chargeability of the toner is so great that effects of the charge controlling agent are reduced, and there may be an increase in electrostatic suction toward a developing roller, potentially causing a decrease in the fluidity of a developer and a decrease in image density. Such a charge controlling agent may be dissolved and dispersed in the toner after melted and kneaded together with a master batch and a resin, or may be directly added into an organic solvent when dissolved and dispersed therein, or may be fixed on the toner particle surface after the formation of toner particles.

When the toner composition is dispersed in the aqueous medium in the toner producing process, fine resin particles mainly for stabilizing the dispersion may be added.

For the fine resin particles, any resin (including thermoplastic resin and thermosetting resin) may be used as long as it is capable of forming an aqueous dispersion element. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used individually or in combination. Among them, preferred are vinyl resins, polyurethane resins, epoxy resins, polyester resins, and combinations thereof because an aqueous dispersion element of fine spherical resin particles can be easily obtained.

As the vinyl resins, polymers each produced by homopolymerizing or copolymerizing a vinyl monomer are used. Examples thereof include styrene-(meth)acrylic acid ester resins, styrene-butadiene copolymers, (meth)acrylic acid-acrylic acid ester copolymers, styrene-acrylonitrile copolymers, styrene-maleic anhydride copolymers and styrene-(meth)acrylic acid copolymers.

Further, fine inorganic particles can be favorably used as an external additive to support the flowability, developability and chargeability of toner particles.

Examples of the inorganic particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, red ochre, antimony trioxide, magnesium oxide, zirconium oxide, barium sulfate, barium carbonate, calcium carbonate, silicon carbide and silicon nitride.

The fine inorganic particles preferably have a primary particle diameter of 5 nm to 2 μm, more preferably 5 nm to 500 nm. Also, the fine inorganic particles preferably have a BET specific surface area of 20 $m^2/g$ to 500 $m^2/g$.

The amount of the fine inorganic particles incorporated into the toner is preferably 0.01% by mass to 5% by mass, more preferably 0.01% by mass to 2.0% by mass.

Besides, fine polymeric particles may be employed and examples thereof include polymer particles of thermosetting resins, polycondensates such as nylons, benzoguanamine and silicones, acrylic acid ester copolymers, methacrylic acid esters and polystyrene obtained by, for example, soap-free emulsion polymerization, suspension polymerization and dispersion polymerization.

Further, a fluidizer may be incorporated into the toner.

Surface treatment by the fluidizer allows toner particles to increase in their hydrophobicity, thereby making it possible to prevent a decrease in the fluidity and chargeability of the toner particles even at high humidity.

Examples of the fluidizer include silane coupling agents, silylating agents, fluorinated alkyl group-containing silane coupling agents, organic titanate-based coupling agents, aluminum-based coupling agents, silicone oils and modified silicone oils.

Examples of a cleanability enhancer for removing a developer which remains on a photoconductor or an intermediate transfer medium after image transfer include fatty acid metal salts such as zinc stearate, calcium stearate and stearic acid, and fine polymer particles produced by soap-free emulsion polymerization or the like, such as fine polymethyl methacrylate particles and fine polystyrene particles. The fine polymer particles have a relatively narrow particle size distribution, and those which are 0.01 nm to 1 μm in volume average particle diameter are preferable.

Use of such a toner makes it possible to form a high-quality toner image superior in stability when developed, as described above.

Also, the image forming apparatus of the present invention can be used with a pulverized toner having an indefinite particle shape as well as with the above-mentioned toner suitable for obtaining high-quality images. Even when the image forming apparatus is used with the pulverized toner having an indefinite particle shape, the lifetime of the apparatus can be greatly lengthened. As the material for such a pulverized toner, any material usually used for electrophotographic toner can be used without any limitation in particular.

Examples of binder resins used for the pulverized toner include homopolymers of styrene and its substituted products, such as polystyrene, poly-p-chlorostyrene and polyvinyl toluene; styrene copolymers such as styrene/p-chlorostyrene copolymers, styrene/propylene copolymers, styrene/vinyl toluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/α-methyl chlormethacrylate copolymers, styrene/acrylonitrile copolymers, styrene/vinyl methyl ketone copolymers, styrene/butadiene copolymers, styrene/isoprene copolymers and styrene/maleic acid copolymers; homopolymers and copolymers of acrylic acid esters, such as polymethyl acrylate, polybutyl acrylate, polymethyl methacrylate and polybutyl methacrylate; polyvinyl derivatives such as polyvinyl chloride and polyvinyl acetate; polyester polymers, polyurethane polymers, polyamide polymers, polyimide polymers, polyol polymers, epoxy polymers, terpene polymers, aliphatic or alicyclic hydrocarbon resins and aromatic petroleum resins. These may be used individually or in combination. Among them, preferred are styrene-acrylic copolymer resins, polyester resins and polyol resins, in terms of electrical property, cost, etc. Furthermore, particularly preferred are polyester resins and polyol resins because of their favorable fixing properties.

As to the pulverized toner, for example, the resin component(s) is/are mixed with the above-mentioned colorant component(s), wax component(s) and charge controlling component(s) in advance if necessary, then they are kneaded at a temperature lower than or equal to a temperature in the vicinity of the melting temperature of the resin component(s), the mixture is cooled and then subjected to a pulverizing and classifying process, and the toner is thus produced; additionally, the above-mentioned externally added component(s) may be suitably added and mixed therewith if necessary.

The above developing device employs a dry developing process or a wet drying process, and may be a single-color or multi-color developing device. Examples of preferred developing devices include those having a rotatable magnetic roller and a stirrer for charging the toner or developer with friction caused during stirring.

In the developing device, toner particles and carrier particles are stirred so that the toner particles are charged by friction generated therebetween. The charged toner particles are retained in the chain-like form on the surface of the rotating magnetic roller to form a magnetic brush. The magnetic roller is disposed proximately to the image bearing member (photoconductor) and thus, some of the toner particles forming the magnetic brush formed on the magnetic roller surface are electrically adsorbed onto the image bearing member (photoconductor) surface. As a result, the electrostatic latent image is developed with the toner particles to form a visible toner image on the image bearing member (photoconductor) surface.

—Other Units—

The other units are not particularly limited and may be appropriately selected depending on the purpose. Examples thereof include a cleaning unit, a protective agent-applying unit, a transferring unit, and a fixing unit.

—Cleaning Unit—

The cleaning unit is not particularly limited, so long as it is a unit configured to clean the surface of the image bearing member, and may be appropriately selected depending on the purpose. For example, a cleaning device capable of cleaning the surface of the image bearing member can be used. In particular, the cleaning unit preferably contains a cleaning blade for cleaning the surface of the image bearing member.

In general, besides the above method using the cleaning blade, another exemplary method for cleaning an image bearing member is an electrostatic cleaning method using a brush to which a voltage opposite to that the remaining toner particles on the image bearing member is applied. This electrostatic cleaning method is so-called reverse development in which toner particles are transferred from the image bearing member to an electrostatic cleaning brush. Thus, when the charged potential of the image bearing member is not uniform as in the present invention, the difference in cleanability of toner disadvantageously occurs using the electrostatic cleaning method.

In contrast, the cleaning unit containing the cleaning blade mechanically removes the remaining toner particles on the image bearing member and thus, the difference in cleanability of toner is not likely to occur. As a result, the surface of the image bearing member can be maintained good and thus, use of the above cleaning unit is preferred.

—Protective Agent-Applying Unit—

The protective agent-applying unit is not particularly limited, so long as it can apply a protective agent for protecting the surface of the image bearing member, and may be appropriately selected depending on the purpose. The protective agent-applying unit is, for example, a protective agent-applying device which can apply a protective agent for protecting the surface of the image bearing member.

When the image forming apparatus has the protective agent-applying unit (protective agent-applying device), the surface of the image bearing member can be assuredly maintained to be good through cleaning. In addition, the formed protective layer can prevent degradation of the surface of the image bearing member which is caused by electrical stress during charging. As a result, the effects of the present invention can be attained for a long period of time.

Notably, when the uppermost surface layer is provided on the image bearing member, the protective layer is provided on the uppermost surface layer.

Here, FIG. 1 schematically shows a cleaning device and a protective agent-applying device.

A protective agent-applying device 2 is disposed so as to face a photoconductor drum 1 serving as an image bearing member, and is composed mainly of an image bearing member-protective agent 21, a protective agent-supplying member 22, a pressing force-applying member 23 and a protective agent-applying member 24.

Through application of a pressing force by the pressing force-applying member 23, the image bearing member-protective agent 21 is brought into contact with the protective agent-supplying member 22 having, for example, a brush shape. The protective agent-supplying member 22 is rotated at a different linear velocity from the image bearing member 1 and slides thereon. In this state, the image bearing member-protective agent held on the surface of the protective agent-supplying member is supplied to the surface of the image bearing member.

The image bearing member-protective agent supplied to the surface of the image bearing member may not form a sufficient protective layer depending on the selected material of the image bearing member-protective agent. Thus, in order to form a more uniform protective layer, the image bearing member-protective agent supplied is treated with a protective layer-forming member having, for example, a blade member to form a thin layer.

The image bearing member having the protective layer is charged by, for example, a charging roller 3 to which a DC voltage or an AC voltage superimposed on a DC voltage is applied from an unillustrated high-voltage power source. Specifically, the charging roller is placed in contact with or close to the image bearing member, and discharge is made to occur in the formed fine gaps to charge the image bearing member. During this charging, some of the protective layer is decomposed or oxidized due to electrical stress, and matter produced through aerial discharge adheres to and degrades the surface of the protective layer.

The degraded image bearing member-protective agent is removed by a common cleaning mechanism together with other components such as toner particles remaining on the image bearing member.

The protective agent-applying member has also such a cleaning mechanism. Nevertheless, since the state where a member suitably slides on the image bearing member for removing matter remaining thereon is different from that where a member suitably slides on the image bearing member for forming a protective layer, preferably, these functions are separated; specifically, as shown in FIG. 1, a cleaning mechanism 4 composed of, for example, a cleaning member 41 and a cleaning pressing force-applying mechanism 42 is provided upstream of an image bearing member-protective agent-supplying portion.

The material of a blade used for the protective layer forming member is not particularly limited and may be appropriately selected depending on the purpose from known materials for a cleaning blade. Examples of the material include urethane rubber, hydrin rubber, silicone rubber and fluorine rubber. These may be used individually or in combination. Additionally, a portion of such a blade (elastic material) which comes into contact with the image bearing member may be coated or impregnated with a low-friction-coefficient material. Further, in order to adjust the hardness of the elastic material used, a filling material such as an organic or inorganic filler may be dispersed.

Such a cleaning blade is fixed to a blade support by a method such as adhesion or fusion bonding so that an end of the blade can be pressed onto the surface of the image bearing member.

Although the thickness of the cleaning blade cannot be unequivocally defined because the thickness is determined in view of the force applied when the blade is pressed, it is preferably 0.5 mm to 5 mm, more preferably 1 mm to 3 mm.

Similarly, although the length of the cleaning blade which protrudes from the blade support and may bend (so-called free length) cannot be unequivocally defined because the length is determined in view of the force applied when the blade is pressed, it is preferably 1 mm to 15 mm, more preferably 2 mm to 10 mm.

Another structure of a blade member for forming a protective layer may be employed in which a coating layer of a resin, rubber, elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

The coating layer contains at least a binder resin and a filler; and, if necessary, contains other components.

The binder resin is not particularly limited and may be appropriately selected depending on the purpose. Examples thereof include fluorine resins such as PFA, PTFE, FEP and PVdF; fluorine-based rubbers; silicone-based elastomer such as methylphenyl silicone elastomer.

The thickness of the elastic metal blade is preferably 0.05 mm to 3 mm, more preferably 0.1 mm to 1 mm. In order to prevent the elastic metal blade from being twisted, the blade may, for example, be bent in a direction substantially parallel to a support shaft after the installation of the blade.

The force with which the image bearing member is pressed by the protective layer forming member is sufficient as long as it allows the image-bearing member protecting agent to spread and form into a protective layer. The force is preferably 5 gf/cm to 80 gf/cm, more preferably 10 gf/cm to 60 gf/cm, in terms of a linear pressure.

A brush-like member is preferably used as the protecting agent supply member; in this case, brush fibers of the brush-like member preferably have flexibility to reduce mechanical stress on the surface of the image bearing member. The material for the flexible brush fibers is not particularly limited and may be appropriately selected depending on the purpose. Examples thereof include polyolefin resins (e.g. polyethylene and polypropylene); polyvinyl resins and polyvinylidene resins (e.g. polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g. polytetrafluoroethylene, polyvinyl fluoride, polyvinylidene fluoride and polychlorotrifluoroethylene); polyesters; nylons; acrylics; rayon; polyurethanes; polycarbonates; phenol resins; and amino resins (e.g. urea-formaldehyde resins, melamine resins, benzoguanamine resins, urea resins and polyamide resins).

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

A support for the protecting agent supply member may be a stationary support or a roll-like rotatable support. The roll-like support for the supply member is exemplified by a roll brush formed by spirally winding a tape with a pile of brush fibers around a metal core. Each brush fiber preferably has a diameter of about 10 μm to about 500 μm and a length of 1 mm to 15 mm. The density of the brush fibers is preferably 10,000 to 300,000 per square inch ($1.5\times10^7$ to $4.5\times10^8$ per square meter).

For the protecting agent supply member, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex× 50 filaments (300 denier=6 denier×50 filaments).

Additionally, if necessary, the brush surface may be provided with a coating layer for the purpose of stabilizing the shape of the brush surface, the environment, etc. As constituent(s) of the coating layer, use of constituent(s) capable of deforming in a manner that conforms to the bending of the brush fibers is preferable, and the constituent(s) is/are not particularly limited, as long as it/they can maintain its/their flexibility. Examples of the constituent(s) include polyolefin resins such as polyethylene, polypropylene, chlorinated polyethylene and chlorosulfonated polyethylene; polyvinyl resins and polyvinylidene resins, such as polystyrene, acrylics (e.g. polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g. modified products made of alkyd resins, polyester resins, epoxy resins, polyurethane resins, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and composite resins thereof.

<Image Bearing Member-Protective Agent>

The component of the image bearing member-protective agent is not particularly limited and may be appropriately selected depending on the purpose. Preferred examples thereof include fatty acid metal salts and saturated hydrocarbon waxes.

—Fatty Acid Metal Salt—

Examples of the fatty acid metal salts include compounds formed between long-chain alkyl carboxylic acid salts (e.g., lauric acid salts, myristic acid salts, palmitic acid salts, stearic acid salts, behenic acid salts, lignoceric acid salts, cerotic acid salts, montanic acid salts and melissic acid salts), each having an anion at the end of a hydrophobic moiety, and alkali metal (e.g., sodium and potassium) ions, alkaline earth metal (e.g., magnesium and calcium) ions, or metal (e.g., aluminum and zinc) ions.

Specific examples thereof include zinc stearate, calcium stearate, magnesium stearate, zinc laurate, calcium laurate and magnesium laurate.

These fatty acid metal salts may be used in combination.

—Saturated Hydrocarbon Wax—

The saturated hydrocarbon wax is not particularly limited and may be appropriately selected depending on the purpose. Preferred are those having a sharp peak of specific melting heat of 80° C. to 130° C. and a low viscosity after melting.

Examples of the saturated hydrocarbon wax include hydrocarbons (e.g., aliphatic saturated hydrocarbons, aliphatic unsaturated hydrocarbons, alicyclic saturated hydrocarbons, alicyclic unsaturated hydrocarbons and aromatic hydrocarbons), vegetable natural waxes (e.g., carnauba wax, rice bran wax and candelilla wax), and animal natural waxes (e.g., beeswax and snow wax).

Particularly preferred are aliphatic saturated hydrocarbons and alicyclic saturated hydrocarbons whose molecular bonds are all stable saturated bonds having less reactivity. Among them, such hydrocarbon waxes as normal paraffin, isoparaffin and cycloparaffin are chemically stable and do not involve addition reaction. Thus, they are not easily oxidized in an atmosphere for practical use, and are preferred in terms of stability over time.

In particular, by using a hydrocarbon wax containing at least one of a Fischer-Tropsch wax and a polyethylene wax, which are relatively hard saturated hydrocarbon waxes, the durability of the protective layer itself can be improved. Thus, even if the thickness of the protective layer formed on the image bearing member is not required to be excessively large, sufficient protection of the image bearing member can be attained. Use of such a wax, therefore, is more preferred.

—Other Components—

In addition to the above components, in order to increase affinity between the image bearing member-protective agent and the image bearing member surface, and assist the formation of a protective agent layer, an amphoteric organic compound such as a surfactant may be used in combination as an additional additive.

The amphoteric organic compound may greatly change the surface characteristics of the main material. The amount of the amphoteric organic compound added is about 0.01% by mass to about 3% by mass, more preferably about 0.05% by mass to about 2% by mass, based on the total mass of the image bearing member-protective agent.

The image bearing member-protective agent may be molded so as to have a certain shape, for example, a prismatic or cylindrical shape using a dry process molding—one of powder molding methods—as well as heat melt molding.

Mono-axial press molding, one typical example of the dry process molding, can be carried out roughly following the procedure described below.

1. Powders of raw materials of the image bearing member-protective agent, which have previously been measured for their specific gravities, are thoroughly mixed one another at desired proportions; and the mixture is weighed so as to give a desired filling ratio.
2. The weighed powder is charged into a mold of a predetermined shape.
3. The charged powder is pressed with a pressing mold, if necessary, under heating, to thereby form a protective agent molded product. This molded product is released from the mold to obtain an image bearing member-protective agent.
4. The obtained image bearing member-protective agent may be cut to appropriately shape it.

The mold is preferably those made of metal (e.g., steel, stainless steel or aluminum), since the metal is excellent in thermal conductivity and dimensional accuracy. Also, the mold may be coated on its inner wall with a releasing agent (e.g., fluorine resins and silicone resins) for improving the releasability of the molded product.

—Transferring Unit—

The transferring unit is a unit configured to transfer a visible image onto a recording medium. Preferably, it is configured to primarily transfer a visible image onto an intermediate member and then secondarily transfer the visible image onto a recording medium. The toner used is two or more color toners, preferably full-color toners. More preferably, transferring includes a primarily transferring step of transferring visible images onto an intermediate member to form a composite transfer image, and a secondarily transferring step of transferring the composite transfer image onto a recording medium.

For example, the transferring can be performed by charging the image bearing member (photoconductor) with a transfer charging device for transfer of the visible image, and using the transferring unit.

The transferring unit preferably has a primarily transferring unit configured to transfer visible images onto an intermediate member to form a composite transfer image, and a secondarily transferring unit configured to transfer the composite transfer image onto a recording medium.

Notably, the intermediate transfer member is not particularly limited and may be appropriately selected from known transferring members. Preferred examples thereof include a transfer belt.

The image bearing member may be an intermediate transfer member used in image formation by a so-called intermediate transfer method in which color toner images formed on photoconductor(s) are primarily transferred so as to be superimposed on top of one another, and then transferred onto a recording medium.

—Intermediate Transfer Member—

The intermediate transfer member preferably has a conductivity of $1.0\times10^5$ Ω·cm to $1.0\times10^{11}$ Ω·cm in volume resistance. If the volume resistance is lower than $1.0\times10^5$ Ω·cm, a phenomenon of so-called transfer dust may arise in which toner images become unstable owing to electric discharge, when the toner images are transferred from the photoconductors onto the intermediate transfer member. If the volume resistance is higher than $1.0\times10^{11}$ Ω·cm, opposing electric charge of a toner image may remain on the intermediate transfer member and thus an afterimage may appear on the next image, after the toner image has been transferred from the intermediate transfer member onto a recording medium such as paper.

For the intermediate transfer medium, a belt-like or cylindrical plastic may, for example, be used which is produced by kneading a thermoplastic resin together with any one or combination of a metal oxide such as tin oxide or indium oxide, a conductive polymer and a conductive particle such as carbon black and then subjecting the mixture to extrusion molding. Besides, it is possible to obtain an intermediate transfer member in the form of an endless belt by heating and centrifugally molding a resin solution containing a thermally crosslinkable monomer or oligomer, with the addition of the above-mentioned conductive particle and/or conductive polymer, if necessary.

When the intermediate transfer member is provided with a surface layer, the materials for the surface layer of the photoconductor, excluding the charge transporting material, may be used for the surface layer after suitably subjected to resistance adjustment with the use of a conductive material.

The transferring unit (the primarily transferring unit and the secondarily transferring unit) preferably contains a transferring device which transfers through charging a visible image formed on an image bearing member (photoconductor) onto a recording medium. The number of the transferring unit may be one or two or more. Examples of the transferring device include a corona transferring device employing corona discharge, a transfer belt, a transfer roller, a press transfer roller and an adhesive transfer device.

Notably, the recording medium is not particularly limited and may be appropriately selected from known recording media (recording paper).

—Fixing Unit—

The fixing unit is a unit configured to fix the visible image transferred onto the recording medium. The fixing may be performed every time when the visible image of each color toner is transferred onto the recording medium. Alternatively, the fixing may be performed at one time on a composite image formed after the visible images of color toners have been laminated.

The fixing unit is not particularly limited and may be appropriately selected depending on the purpose. Known heating/pressing units are preferred.

Examples of the heating/pressing units include a combination of a heating roller and a pressing roller and a combination of a heating roller, a pressing roller, and an endless belt.

In general, the heating temperature in the heating/pressing unit is preferably 80° C. to 200° C.

Notably, known light fixing devices, etc. may be used as desired in addition to or instead of the above fixing device.

Figure 2:
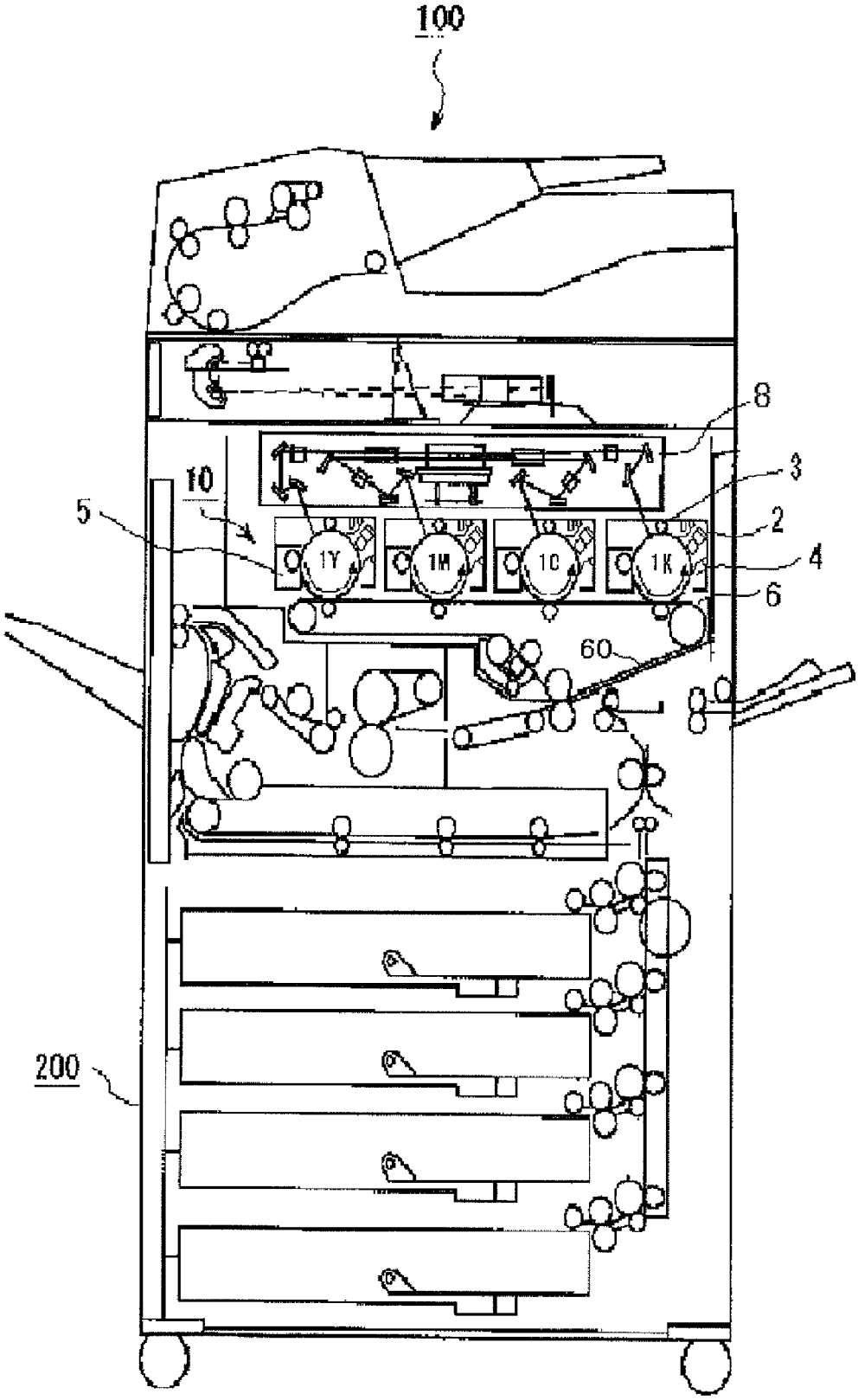
FIG. 2 is a schematic view of an exemplary image forming apparatus of the present invention.

With reference to the drawing, next will be described the image forming apparatus of the present invention. FIG. 2 is a cross-sectional view of an image forming apparatus 100.

This image forming apparatus includes drum-shaped image bearing members 1Y, 1M, 1C and 1K. Around each image bearing member are provided a protective layer-forming device 2, a charging device 3, a latent image-forming device 8, a developing device 5, a transferring device 6 and a cleaning device 4. Image formation by the image forming apparatus is performed as follows.

Next will be described a series of image forming processes employing the nega-posi process.

Each image bearing member (e.g., an organic photoconductor (OPC)) having an organic photoconductive layer is charge-eliminated by, for example, a charge-eliminating lamp (not shown), and then uniformly negatively charged by a charging device 3 having a charging member.

When the image bearing members are charged by the corresponding charging devices, a voltage of appropriate intensity or a charged voltage made by superimposing an AC voltage onto the voltage, which is suitable for charging each of the image bearing members 1Y, 1M, 1C and 1K to a desired electric potential, is applied from a voltage-applying device (not shown) to each charging member.

On the charged image bearing members 1Y, 1M, 1C and 1K, a latent image is formed utilizing a laser beam applied by the latent image-forming device 8 based upon a laser optical system or the like (the absolute value of the electric potential of the exposed portion is smaller than that of the electric potential of the unexposed portion).

The laser beam is emitted from a semiconductor laser, and the surfaces of the image bearing members 1Y, 1M, 1C and 1K is scanned in the direction of the rotational shaft of each image bearing member, using a multifaceted mirror of a polygonal column (polygon) or the like which rotates at high speed.

The latent image thus formed is developed with a developer which is made of toner particles or a mixture of toner particles and carrier particles, supplied onto the development sleeve (i.e., a developer bearing member) of the developing device 5, and a visible toner image is thereby formed.

When the latent image is developed, a voltage of appropriate intensity or a developing bias made by superimposing an AC voltage onto the voltage is applied from the voltage applying mechanism (not shown) to a development sleeve, with the intensity being between the intensities of the voltages for the exposed portion and the unexposed portion of each of the image bearing members 1Y, 1M, 1C and 1K.

Toner images formed on image bearing members 1Y, 1M, 1C and 1K for yellow, magenta, cyan and black respectively are transferred onto an intermediate transfer member 60 by a transfer rollers 6, and then, the transferred toner image is transferred onto a recording medium such as paper fed from a paper feed section 200.

An electric potential having the opposite polarity to the polarity of the toner charging is preferably applied to the transfer device 6 as a transfer bias. Thereafter, the intermediate transfer member 60 is separated from the image bearing members, and the transferred image is obtained.

Toner particles remaining on each image bearing member are recovered by a cleaning member into a toner recovery chamber inside the cleaning device 4 by a cleaning member.

The image forming apparatus includes a plurality of developing devices, and may be an apparatus in which a plurality of toner images of different colors that have been sequentially produced by the developing devices are sequentially transferred onto a recording medium, and fixed by, for example, heat at a fixing mechanism; or an apparatus in which a plurality of toner images similarly produced are sequentially transferred to an intermediate transfer member, and then a composite toner image is transferred at one time onto a recording medium and fixed similarly.

The charging device 3 is preferably a charging device placed in contact with or close to the surface of the image bearing member. This makes it possible to greatly reduce the amount of ozone generated at the time of charging in comparison with corona dischargers using discharge wires, which are so-called corotron dischargers and scorotron dischargers.

As described above, the image forming apparatus of the present invention increases stability of image quality by compensating for the ununiformity of the potential of a latent electrostatic image on an image bearing member in a direction along its rotational axis with the ununiformity of a developing gap. Thus, it can stably form a remarkably high-quality image for a long period of time.

(Process Cartridge)

The image bearing member, the latent electrostatic image forming unit, the developing unit, the transferring unit and the cleaning unit may be housed together to form a process cartridge. The process cartridge additionally includes other units such as a protective layer-forming unit and a charge eliminating unit.

The process cartridge may be detachably mounted to various electrophotographic apparatuses, and preferably, is detachably mounted to the image forming apparatus.

Here, FIG. 3 is a schematic view for describing constituent components of a process cartridge.

The process cartridge includes a photoconductor drum 1 (image bearing member 1) and a protective layer forming device 2 disposed to face the photoconductor drum. The protective layer forming device includes an image-bearing member protecting agent 21, a protective agent-supplying member 22, a pressing force-applying member 23, and a protective layer-forming member 24.

Toner components, an image-bearing member protecting agent which has partially degraded, etc. remain on the surface of the image bearing member 1 after a transferring step; such residual matter on the surface is cleaned off by a cleaning member 41.

In FIG. 3, the cleaning member is in contact with the photoconductor drum at an angle related to a so-called counter type (reading type).

The image bearing member-protective agent 21 is supplied from the protective agent-supplying member 22 to the image bearing member surface from which residual toner particles and a degraded image bearing member-protective agent have been removed by a cleaning mechanism, and then is treated with the protective layer-forming member 24 to form a protective layer in the form of film. The image bearing member-protective agent used in the present invention considerably adsorbs to a portion of the image bearing member surface which is highly hydrophilic through application of electrical stress. Thus, even when the image bearing member surface partially degrades by large electrical stress temporarily applied, the protective agent adsorbs to the degraded portion to thereby prevent degradation of the image bearing member itself.

The protective layer-formed image bearing member is charged with a charging roller 3, and then is exposed to exposing light L such as laser beams to form a latent electrostatic image. The latent electrostatic image is developed with a developing device 5 to form a visible image, which is transferred onto a recording medium 7 with a transferring roller 6 disposed outside the process cartridge.

EXAMPLES

The present invention will next be described by way of examples, which should not be construed as limiting the present invention thereto. Notably, in the Examples, the unit "part(s)" is on the mass basis.

Example 1

Fabrication of Image Bearing Member 1

An aluminum cylinder having a diameter of 40 mm was provided as a conductive cylindrical support. The aluminum cylinder was coated through immersion sequentially with an underlying layer-coating liquid, a charge generation layer-coating liquid, and a charge transport layer-coating liquid, each of which has the following composition, followed by drying, to thereby fabricate image bearing member 1 having an organic photoconductive layer; i.e., a 3.5 μm-thick underlying layer, a 0.2 μm-thick charge generation layer, and an about 30 μm-thick charge transport layer.

Underlying Layer-Coating Liquid

The aluminum cylinder was coated through immersion with the underlying layer-coating liquid having the following composition, followed by drying under heating at 120° C. for 25 min, to thereby form the 3.5 μm-thick underlying layer.

Alkyd resin: 6 parts (BECKOSOL 1307-60-EL, product of Dainippon Ink and Chemicals Inc.)

Melamine resin: 4 parts (SUPER BECKAMINE G-821-60, product of Dainippon Ink and Chemicals Inc.)

Titanium oxide (CR-EL, product of ISHIHARA SANGYO KAISHA LTD.); 40 parts

Methyl ethyl ketone: 200 parts

Charge Generation Layer-Coating Liquid

The underlying layer was coated through immersion with the charge generation layer-coating liquid having the following composition, followed by drying under heating at 120° C. for 20 min, to thereby form the 0.2 μm-thick charge generation layer.

Oxotitanium phthalocyanine pigment: 2 parts

Polyvinyl butyral: 0.2 parts (ESRECK BM-S, product of Sekisui Chemical Co., Ltd.)

Tetrahydrofuran: 50 parts

Charge Transport Layer-Coating Liquid

The charge generation layer was coated through immersion with the charge transport layer-coating liquid having the following composition, followed by drying at 135° C. for 20 min, to thereby form the charge transport layer. Notably, by adjusting the pulling rate of the cylinder from the charge transport layer-coating liquid in immersion coating, the thickness of the charge transport layer was made to be slightly different between the upper and lower ends of the image bearing member, so that the lower end thereof was slightly thicker.

Charge transport compound (D-1) having the following Structural Formula: 10 arts (D-1)

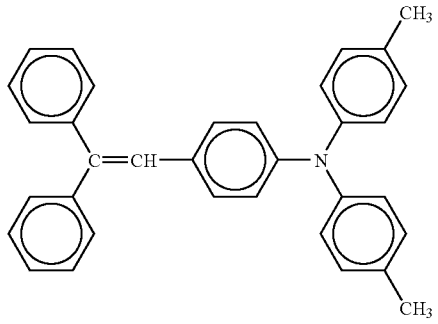

Bisphenol Z polycarbonate: 10 parts (Panlite TS-2050, product of TEIJIN CHEMICALS LTD.)

Silicone oil: 0.002 parts (KF-50, product of Shin-Etsu Chemical Co., Ltd.)

Tetrahydrofuran: 100 parts

Figure 4:
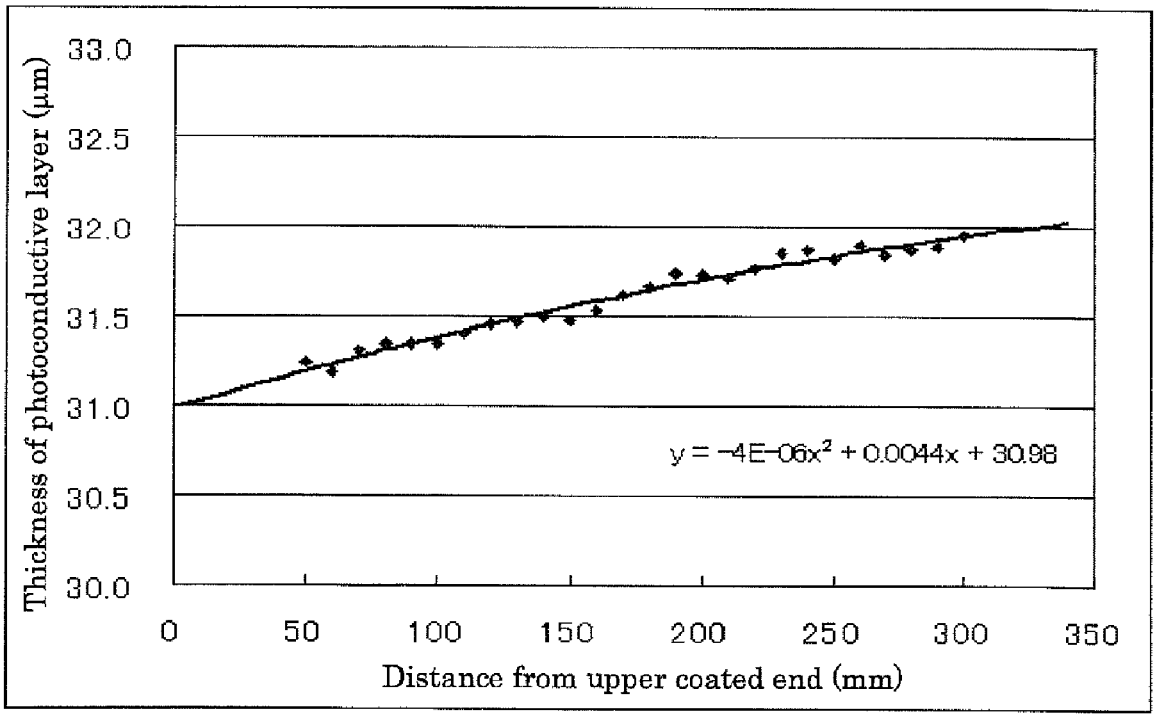
FIG. 4 is a profile obtained by measuring the thickness of an organic photoconductive layer of an image bearing member 1.

Then, the thickness of the organic photoconductive layer (composed of the underlying layer, the charge generation layer, and the charge transport layer) of the thus-obtained image bearing member 1 was measured using an eddy current thickness meter (versatile thickness meter LZ-200, product of Kett Electric Laboratory, LHP-20 (NFe)-type probe). Specifically, the thickness of the organic photoconductive layer was measured at 26 points along the rotational axis of the image bearing member, to thereby obtain a profile regarding the thickness of the organic photoconductive layer. The profile is shown in FIG. 4.

Next, based on the measurements for the thickness of the organic photoconductive layer, an approximation formula was obtained by the least-squares method in the form of a quadratic function using the positional data (measurements points) and the thickness of the organic photoconductive layer at each measurement point. From this approximation, it was found that the thickness of the organic photoconductive layer monotonically increased in a range where the organic photoconductive layer was present, the maximum thickness was 32.0 μm at the lower end (one end), the minimum thickness was 31.0 μm at the upper end (the other end), and the difference between the both ends was 1.0 μm. The measurements are shown in Table 1.

The image bearing member 1 was provided with flanges at the both ends, and was set in an image forming apparatus so that the lower end thereof, where the thickness of the organic photoconductive layer was thicker, was inserted into the image forming apparatus. Subsequently, the image bearing member 1 was mounted in an image forming unit, which was an image forming unit for imagio MP C4500 (product of Ricoh Company Ltd.) having been modified so that the developing gap was adjusted, so that the developing gap at the far side with respect to the port into which the image bearing member had been inserted was 286 μm and that at the near side with respect thereto was 266 μm (the difference in developing gap between the both sides=20 μm, $D_r$=6.99%), to thereby fabricate an image forming unit. The developing gap was adjusted by butting the development sleeve against the support of the image bearing member 1 using butting rollers having different diameters and/or gap tapes having different thicknesses, which were provided on the both ends. The image forming unit used was a Cyan unit.

Further, the image forming unit was mounted in imagio MP C4500 (product of Ricoh Company Ltd.) to fabricate an image forming apparatus of Example 1. Then, the image forming apparatus was caused to form an image. Specifically, an A4-size printed image of 600 dpi (pixel density: 25%, 2 by 2 entire tone) was formed to confirm the uniformity of the visible image. The initial image was visually observed for uniformity. Also, it was observed with a ×25 loupe for uniformity of dots and evaluated according to the evaluation criteria given below.

As a result, a tone image having remarkably excellent uniformity was found to be obtained. Evaluation results are shown in Table 1.

The following evaluation criteria for uniformity of an image were employed when the image was visually observed and when the image was observed in a magnified state.

Notably, when the image was observed in a magnified state, dot diameters (equivalent-area-circle diameters) were measured at three portions; i.e., a center portion and both end portions in a width direction of the image (along the axis of the development sleeve). At each measurement portion, average values of the dot diameters were calculated. Then, the maximum value $R_{max}$ (μm) of the average values and the minimum value $R_{min}$ (μm) thereof were determined and the ratio $R_r$ ($R_r=R_{min}/R_{max}$) was evaluated according to the following criteria.

<Evaluation Criteria for Uniformity Through Visual Observation>

A: Very excellent (no ununiformity observed throughout the entire surface)

B: Non-problematic for practical use (slight ununiformity observed as compared with the image evaluated as A)

C: Acceptable for practical use (ununiformity observed as compared with the image evaluated as A)

D: Unusable (clear ununiformity observed solely; i.e., without being compared with the image evaluated as A)

<Evaluation Criteria for Uniformity of Magnified Image>

A: Very excellent (very uniform dot size; $0.9 \leqq R_r$)

B: Non-problematic for practical use (in a few portions, dot sizes are different at different observed portions; $0.8 \leqq R_r < 0.9$)

C: Acceptable for practical use (in some portions, dot sizes are different at different observed portions; $0.6 \leqq R_r < 0.8$)

D: Unusable (in several portions, dot sizes are different at different observed portions; $R_r < 0.6$)

TABLE 1

| | | Thickness of organic photoconductive layer | | | Developing gap | | | | Image evaluation | |
|---|---|---|---|---|---|---|---|---|---|---|
| | | Near side $T_{min}$ (μm) | Far side $T_{max}$ (μm) | $T_{max}-T_{min}$ (μm) | Near side $D_{min}$ (μm) | Far side $D_{max}$ (μm) | $D_{max}-D_{min}$ (μm) | $D_r$ (%) | Visual observation | Mgnified state |
| Ex. 1 | IMB 1 | 31.0 | 32.0 | 1.0 | 266 | 286 | 20 | 6.99 | B | C |
| Ex. 2 | IMB 1 | 31.0 | 32.0 | 1.0 | 271 | 286 | 15 | 5.24 | A | A |
| Ex. 3 | IMB 1 | 31.0 | 32.0 | 1.0 | 276 | 286 | 10 | 3.50 | A | A |
| Ex. 4 | IMB 1 | 31.0 | 32.0 | 1.0 | 281 | 286 | 5 | 1.75 | B | C |
| Ex. 5 | IMB 1 | 31.0 | 32.0 | 1.0 | 180 | 200 | 20 | 10.00 | C | C |
| Ex. 6 | IMB 1 | 31.0 | 32.0 | 1.0 | 184 | 200 | 16 | 8.00 | C | C |
| Ex. 7 | IMB 1 | 31.0 | 32.0 | 1.0 | 186 | 200 | 14 | 7.00 | B | B |
| Ex. 8 | IMB 1 | 31.0 | 32.0 | 1.0 | 190 | 200 | 10 | 5.00 | A | A |
| Ex. 9 | IMB 1 | 31.0 | 32.0 | 1.0 | 195 | 200 | 5 | 2.50 | B | B |
| Ex. 10 | IMB 1 | 31.0 | 32.0 | 1.0 | 380 | 400 | 20 | 5.00 | B | C |
| Ex. 11 | IMB 1 | 31.0 | 32.0 | 1.0 | 385 | 400 | 15 | 3.75 | B | B |
| Ex. 12 | IMB 1 | 31.0 | 32.0 | 1.0 | 390 | 400 | 10 | 2.50 | B | B |
| Ex. 13 | IMB 1 | 31.0 | 32.0 | 1.0 | 392 | 400 | 8 | 2.00 | B | C |
| Ex. 14 | IMB 1 | 31.0 | 32.0 | 1.0 | 395 | 400 | 5 | 1.25 | C | C |
| Ex. 15 | IMB 1 | 31.0 | 32.0 | 1.0 | 230 | 250 | 20 | 8.00 | C | C |
| Ex. 16 | IMB 1 | 31.0 | 32.0 | 1.0 | 233 | 250 | 17 | 6.80 | B | B |
| Ex. 17 | IMB 1 | 31.0 | 32.0 | 1.0 | 245 | 250 | 5 | 2.00 | B | B |
| Ex. 18 | IMB 2 | 31.7 | 32.0 | 0.3 | 276 | 286 | 10 | 3.50 | A | A |
| Ex. 19 | IMB 3 | 30.5 | 32.0 | 1.5 | 276 | 286 | 10 | 3.50 | B | B |
| Ex. 20 | IMB 4 | 31.9 | 32.0 | 0.1 | 276 | 286 | 10 | 3.50 | B | B |
| Ex. 21 | IMB 5 | 30.0 | 32.0 | 2.0 | 276 | 286 | 10 | 3.50 | B | C |
| Ex. 22 | IMB 6 | 49.0 | 50.0 | 1.0 | 276 | 286 | 10 | 3.50 | B | B |
| Ex. 23 | IMB 7 | 19.0 | 20.0 | 1.0 | 276 | 286 | 10 | 3.50 | A | B |
| Ex. 24 | IMB 8 | 50.0 | 51.0 | 1.0 | 276 | 286 | 10 | 3.50 | C | C |
| Ex. 25 | IMB 9 | 18.0 | 19.0 | 1.0 | 276 | 286 | 10 | 3.50 | B | C |
| Comp. Ex. 1 | IMB 1 | 31.0 | 32.0 | 1.0 | 286 | 286 | 0 | 0.00 | C | D |
| Comp. Ex. 2 | IMB 1 | 31.0 | 32.0 | 1.0 | *296 | *286 | −10 | 3.38 | D | D |
| Comp. Ex. 3 | IMB 10 | 32.0 | 32.0 | 0.0 | 276 | 286 | 10 | 3.50 | C | D |
| Comp. Ex. 4 | IMB 11 | *33.0 | *32.0 | −1.0 | 276 | 286 | 10 | 3.50 | D | D |
| Comp. Ex. 5 | IMB 12 | 31.9 | 32.0 | — | 276 | 286 | 10 | 3.50 | D | D |
| Comp. Ex. 6 | IMB 13 | 32.2 | 32.0 | — | 276 | 286 | 10 | 3.50 | D | D |

*In Comparative Example 2, $D_{min}$ denotes a gap at the far side with respect to the port into which the image bearing member had been inserted, and $D_{max}$ denotes a gap at the near side with respect thereto. In Comparative Example 4, $T_{min}$ denotes a thickness of the organic photoconductive layer at the far side with respect to the port into which the image bearing member had been inserted, and $T_{max}$ denotes a thickness of the organic photoconductive layer at the near side with respect thereto. In Comparative Example 4, $T_{min}$ denotes a thickness of the organic photoconductive layer at the far side with respect to the port into which the image bearing member had been inserted, and $T_{max}$ denotes a thickness of the organic photoconductive layer at the near side with respect thereto.
Note that "IMB" stands for an image bearing member.

Examples 2 to 17 and Comparative Examples 1 and 2

Figure 7:
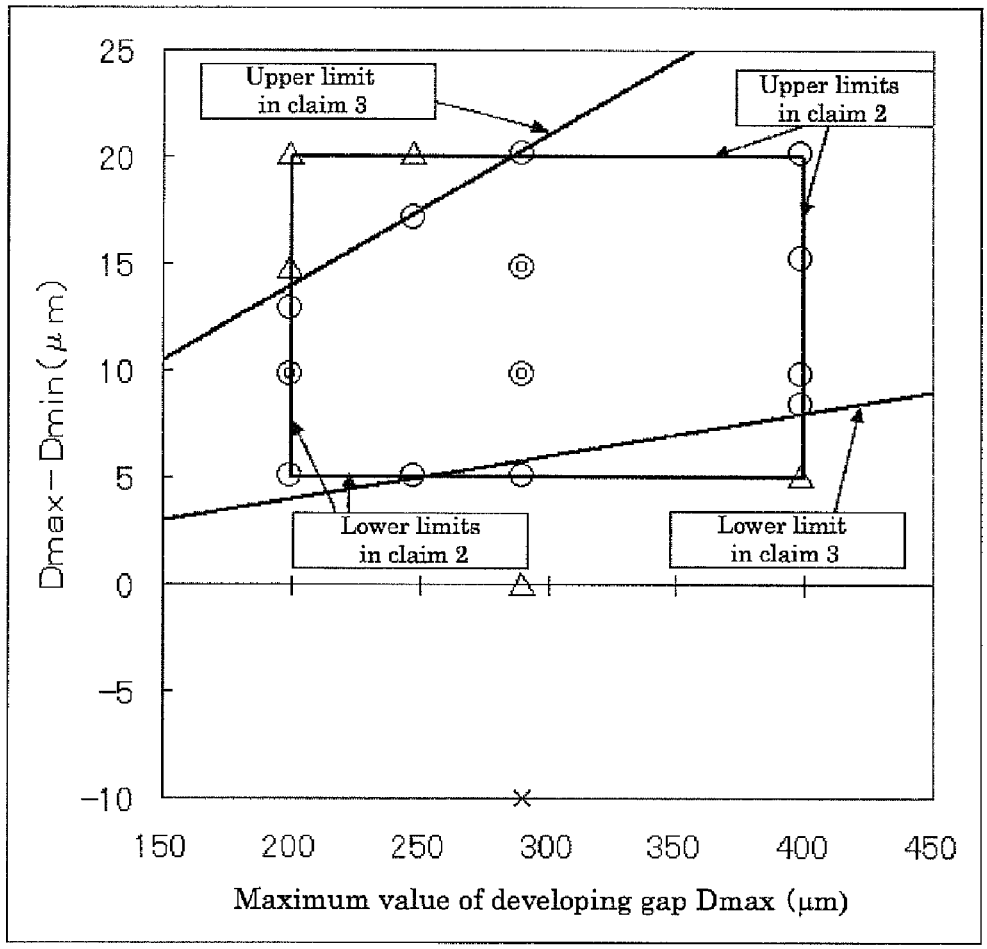
FIG. 7 is a constellation diagram of a relationship between a developing gap and image evaluation results of Examples of the present invention and Comparative Examples.

In order to investigate the relationship in size between the thickness of the organic photoconductive layer and the developing gap, and to determine a suitable range of the developing gap, in the same manner as in Example 1, except that the developing gap of the image forming unit using the image bearing member 1 was adjusted as shown in Table 1, to thereby fabricate image forming apparatuses of Examples 2 to 17 and Comparative Examples 1 and 2. The thus-fabricated image forming apparatuses were evaluated similar to Example 1. Evaluation results are shown in Table 1. Also, ranks for uniformity of each image are located on a two-dimensional coordinate of $D_{max}$ vs. $D_{max}-D_{min}$ (see FIG. 7). Specifically, in FIG. 7, the ranks (A, B, C and D) of Examples 1 to 17 and Comparative Examples 1 and 2 obtained through visual observation are located on the corresponding coordinates of the two-dimensional coordinate. Here, in FIG. 7, rank A is shown by a double circle, rank B by a single circle, rank C by a triangle, and rank D by a cross.

The evaluation results of Examples and Comparative Examples indicate that, when the developing gap is varied using the same image bearing member, there is a certain range where a high-quality image can be obtained.

These results indicate that the image forming apparatus of the present invention can form a high-quality image.

Also, even when an organic photoconductive layer of an image bearing member involves variation in thickness, a uniform image can be obtained, potentially reducing the production cost of an image bearing member.

Examples 18 to 25 and Comparative Examples 3 and 4

In order to confirm a suitable range in relation to various conditions such as the thickness of an organic photoconductive layer, variation in the thickness, and the size of the developing gap, the production conditions for the image bearing member 1 were varied to fabricate image bearing members 2 to 11 having photoconductive layers with different thicknesses and with different thickness deviations in a direction along each rotational axis. In the same manner as in Example 3, except that an image forming unit in which each of the image bearing members had been mounted was used, and the developing gap was adjusted to the same value as in Example 3 shown in Table 1, to thereby fabricate image forming apparatuses of Examples 18 to 25 and Comparative Examples 3 and 4. The thus-fabricated image forming apparatuses were evaluated similar to Example 1. Evaluation results are shown in Table 1.

These results indicate that, even when the organic photoconductive layer of the image bearing member is varied in thickness, the image forming apparatus of the present invention can provide a satisfactorily high-quality image.

Further, as is clear from the comparison of Examples with Comparative Examples, the image forming apparatus of the present invention can provide a uniform image even when a photoconductive layer of an image bearing member is varied in thickness, potentially reducing the production cost of the image bearing member.

Comparative Examples 5 and 6

Figure 5:
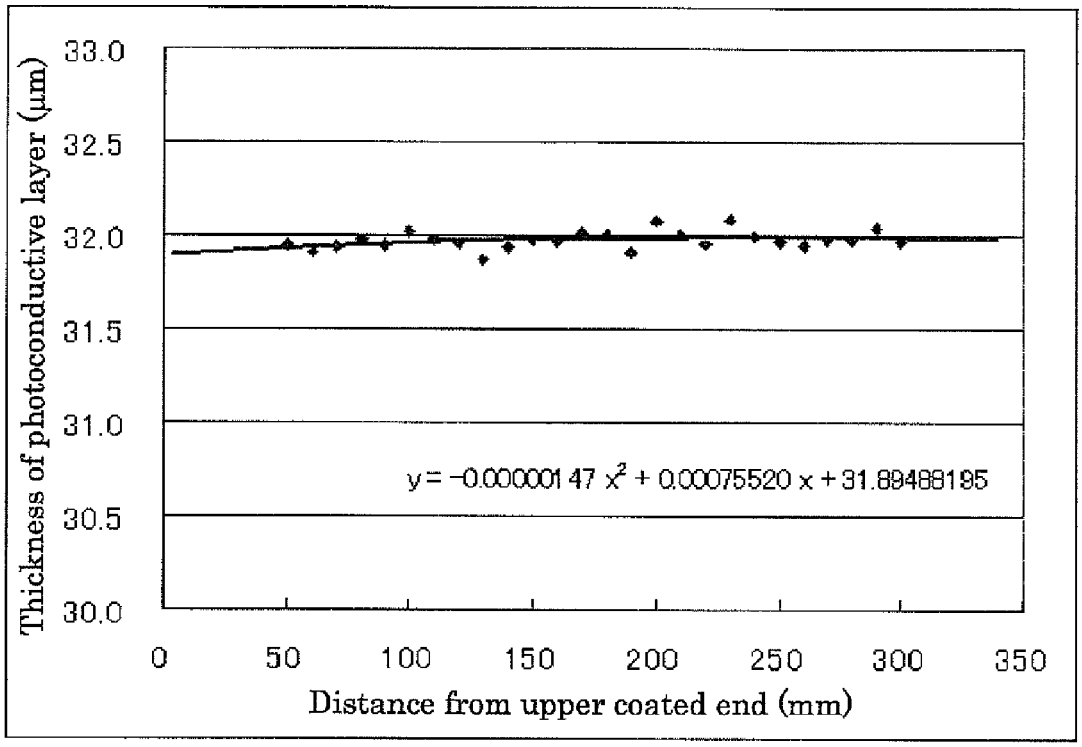
FIG. 5 is a profile obtained by measuring the thickness of an organic photoconductive layer of an image bearing member 12, wherein the thickness is a maximal value at a distance of 256.9 mm.
Figure 6:
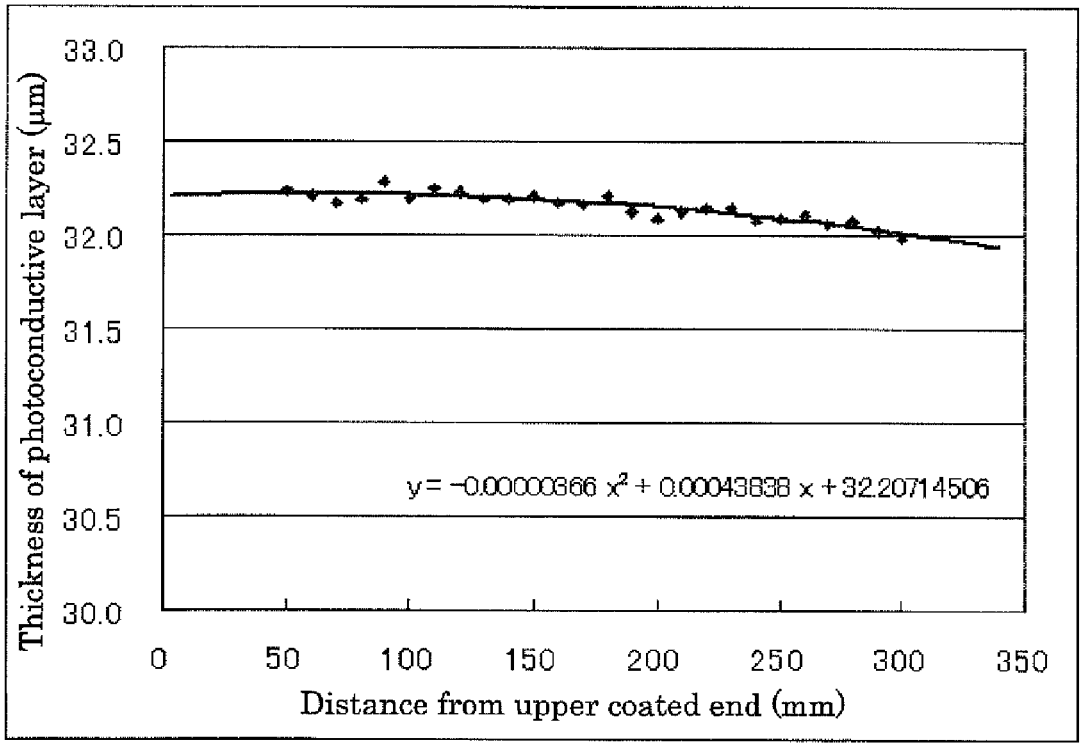
FIG. 6 is a profile obtained by measuring the thickness of an organic photoconductive layer of an image bearing member 13, wherein the thickness is a maximal value at a distance of 60.0 mm.

In order to fabricate an organic photoconductive layer whose thickness does not monotonically decrease or increase, the production conditions for the image bearing member 1 were controlled, to thereby fabricate image bearing members 12 and 13 each having a photoconductive layer whose maximal value in thickness existed in a direction along the rotational axis in a range where the organic photoconductive layer was present. The thickness profiles of the organic photoconductive layers are shown in FIGS. 5 and 6. In the same manner as in Example 3, except that an image forming unit in which each of the image bearing members had been mounted was used, and the developing gap was adjusted to the same value as in Example 3 shown in Table 1, to thereby fabricate image forming apparatuses of Comparative Examples 5 and 6. The thus-fabricated image forming apparatuses were evaluated similar to Example 1. Evaluation results are shown in Table 1.

These results indicate that, when the organic photoconductive layer of the image bearing member does not monotonically increase or decrease, a satisfactorily high-quality image cannot be obtained. Further, in only a part of the image bearing member along the rotational axis, a high-quality image was able to be obtained. This indicates that, when the image bearing member has an organic photoconductive layer whose thickness does not monotonically increase or decrease, a high-quality image can be obtained in very limited conditions of the thickness of an organic photoconductive layer and the developing gap. However, it is difficult to maintain the entire image area to be high in image quality. If an image whose quality is entirely high is to be obtained using an image bearing member containing an organic photoconductive layer whose thickness does not monotonically increase or decrease, much effort and cost will be required.

Finally, 10,000 A4-size 5%-chart paper sheets were passed through the image forming apparatus of Example 3, and then, the image forming apparatus was caused to output the similar tone image, followed by evaluation. As a result, this image was found to be a remarkably uniform tone image similar to the initial image.

What is claimed is:

1. An electrophotographic image forming apparatus comprising:

an image bearing member which is a rotatable photoconductor containing at least an organic photoconductive layer on a conductive cylindrical support, a latent electrostatic image forming unit configured to charge the image bearing member so as to form a latent electrostatic image thereon, and a developing unit configured to develop the latent electrostatic image on the image bearing member with a developer so as to form a visible image, wherein the thickness of the organic photoconductive layer monotonically decreases or increases in a direction along a rotational axis of the image bearing member from one end to the other end of the image bearing member, wherein the developing unit comprises a development sleeve for bearing and transferring the developer to a developing region, and wherein a development gap is formed between the image bearing member and the development sleeve, and becomes narrower from one end of the image bearing member where the organic photoconductive layer is thicker to the other end of the image bearing member where the organic photoconductive layer is thinner.

2. The electrophotographic image forming apparatus according to claim 1, wherein the developing gap satisfies the relations $5 \leqq D_{max}-D_{min} \leqq 20$ and $200 \leqq D_{max} \leqq 400$, where $D_{max}$ denotes a maximum value (μm) of the developing gap and $D_{min}$ denotes a minimum value (μm) of the developing gap.

3. The electrophotographic image forming apparatus according to claim 1, wherein the developing gap has a $D_r$ (%) of 2% to 7% which is defined by the following Equation 1:

$$D_r=(D_{max}-D_{min})/D_{max}-100(\%) \quad \text{Equation 1}$$

4. The electrophotographic image forming apparatus according to claim 1, wherein the thickness of the organic photoconductive layer satisfies the relations $0.3 \leqq T_{max}-T_{min} \leqq 1.5$ and $20 \leqq T_{max} \leqq 50$, where $T_{max}$ denotes a maximum thickness (μm) of the organic photoconductive layer and $T_{min}$ denotes a minimum thickness (μm) of the organic photoconductive layer.

5. The electrophotographic image forming apparatus according to claim 1, wherein the latent electrostatic image forming unit comprises a charging unit which is constant-current controlled.

6. The electrophotographic image forming apparatus according to claim 1, wherein the latent electrostatic image forming unit comprises a charging roller which charges the image bearing member with being placed in contact with or close to the image bearing member.

7. The electrophotographic image forming apparatus according to claim 1, further comprising a cleaning unit configured to clean a surface of the image bearing member, wherein the cleaning unit comprises a cleaning blade.

8. The electrophotographic image forming apparatus according to claim 1, further comprising a protective agent-applying unit configured to apply a protective agent for protecting a surface of the image bearing member.

9. The electrophotographic image forming apparatus according to claim 1, wherein an uppermost surface layer is laid over the organic photoconductive layer.

10. The electrophotographic image forming apparatus according to claim 9, wherein the uppermost surface layer has a thickness of 0.1 μm to 12 μm.

11. The electrophotographic image forming apparatus according to claim 1, wherein the development sleeve comprises two developing gap-adjusting rollers one of which has a larger diameter than the diameter of the other, and the developing gap-adjusting roller having the larger diameter is disposed at one end of the development sleeve at which the developing gap is larger than that of the other end of the development sleeve, and the developing gap-adjusting roller having the smaller diameter is disposed at the other end of the development sleeve at which the developing gap is smaller.

12. A process cartridge used in an electrophotographic image forming apparatus, the process cartridge comprising:

an image bearing member which is a rotatable photoconductor containing at least an organic photoconductive layer on a conductive cylindrical support, a latent electrostatic image forming unit configured to charge the image bearing member so as to form a latent electrostatic image thereon, and a developing unit configured to develop the latent electrostatic image on the image bearing member with a developer so as to form a visible image, wherein the thickness of the organic photoconductive layer monotonically decreases or increases in a direction along a rotational axis of the image bearing member from one end to the other end of the image bearing member, wherein the developing unit comprises a development sleeve for bearing and transferring the developer to a developing region, and wherein a development gap is formed between the image bearing member and the development sleeve, and becomes narrower from one end of the image bearing member where the organic photoconductive layer is thicker to the other end of the image bearing member where the organic photoconductive layer is thinner.

* * * * *